US011130669B2

(12) United States Patent
Williams et al.

(10) Patent No.: US 11,130,669 B2
(45) Date of Patent: Sep. 28, 2021

(54) FUEL DELIVERY SPOUT FOR AVOIDING MISFUELLING AND METHOD THEREFOR

(71) Applicant: Berrys (Holdings) Technologies Limited, Birmingham (GB)

(72) Inventors: Jacque Williams, Bromyard (GB); Martin Gerard Berry, Naples, FL (US)

(73) Assignee: Berrys (Holdings) Technologies Limited, Birmingham (GB)

( * ) Notice: Subject to any disclaimer, the term of this patent is extended or adjusted under 35 U.S.C. 154(b) by 0 days.

(21) Appl. No.: 16/970,016

(22) PCT Filed: Feb. 18, 2019

(86) PCT No.: PCT/GB2019/050429
§ 371 (c)(1),
(2) Date: Aug. 14, 2020

(87) PCT Pub. No.: WO2019/158945
PCT Pub. Date: Aug. 22, 2019

(65) Prior Publication Data

US 2021/0101794 A1 Apr. 8, 2021

(30) Foreign Application Priority Data

Feb. 16, 2018 (GB) ..... 1802544
Jul. 12, 2018 (GB) ..... 1811420

(51) Int. Cl.
*B67D 7/34* (2010.01)
*B67D 7/04* (2010.01)

(52) U.S. Cl.
CPC ..... *B67D 7/342* (2013.01); *B67D 7/34* (2013.01); *B67D 7/04* (2013.01); *B67D 2007/0444* (2013.01); *B67D 2007/0453* (2013.01)

(58) Field of Classification Search
CPC ..... B67D 7/04; B67D 2007/0444; B67D 2007/0453; B67D 7/34; B67D 7/342
See application file for complete search history.

(56) References Cited

U.S. PATENT DOCUMENTS 3,628,867 A 12/1971 Brady
4,438,749 A 3/1984 Schwippert
(Continued)

FOREIGN PATENT DOCUMENTS

DE 20114800 2/2002
EP 0598341 5/1994
(Continued)

OTHER PUBLICATIONS

International Search Report and the Written Opinion of the International Searching Authority corresponding to International Patent Application No. PCT/GB2019/050429 (21 pages) (dated Aug. 8, 2019).
(Continued)

*Primary Examiner* — Timothy L Maust
(74) *Attorney, Agent, or Firm* — Myers Bigel, P.A.

(57) ABSTRACT

Fuel dispenser (100) comprising: a fluid inlet (105IN) for receiving fuel from a fuel source, a fluid outlet (105OUT) and a conduit (110) disposed therebetween; inspection means (152) for inspecting the fuel within the conduit (110), the inspection means (152) being configured to provide an output indicative of a type of fuel in the conduit (110); valve means (120) operable selectively to prevent or allow flow of fluid through the conduit (110) from the fluid inlet (105IN) to the fluid outlet (105OUT); and control means (150) configured automatically to cause the valve means (120) to prevent or allow flow of fuel through the conduit (110) in dependence on the output of the fuel inspection means (152) and permitted fluid information, the permitted fluid information being information indicative of a type of fuel that is
(Continued)

to be permitted to flow through the conduit (110), the apparatus (100) comprising an electrical generator (140) configured to generate electrical power to charge a charge storage device in response to flow of fluid through the apparatus (100) during an operation in which fluid flows from the fluid inlet (105IN) to the fluid outlet (105OUT) via the conduit (110), the charge storage device being arranged to provide a supply of electrical power for the apparatus.

22 Claims, 21 Drawing Sheets

(56) References Cited

U.S. PATENT DOCUMENTS

| | | | | |
|---|---|---|---|---|
| 5,157,453 | A | 10/1992 | Suzuki et al. | |
| 5,172,738 | A | 12/1992 | Komukai et al. | |
| 5,452,076 | A | 9/1995 | Schopper et al. | |
| D368,919 | S | 4/1996 | Lannoch | |
| 5,507,326 | A * | 4/1996 | Cadman | B67D 7/342 141/1 |
| 5,722,469 | A * | 3/1998 | Tuminaro | B67D 7/342 141/83 |
| 6,199,603 | B1 | 3/2001 | Kauppila et al. | |
| 6,250,347 | B1 * | 6/2001 | Tatsuno | B67D 7/0401 141/104 |
| 6,374,845 | B1 | 4/2002 | Melendez et al. | |
| 6,374,870 | B1 * | 4/2002 | Muller | B67D 7/067 141/94 |
| 6,648,032 | B1 * | 11/2003 | Kelrich | B67D 7/348 141/1 |
| 6,712,102 | B2 * | 3/2004 | Zerangue, Sr. | B60K 15/04 141/1 |
| D673,595 | S | 1/2013 | Cho et al. | |
| D676,884 | S | 2/2013 | Zhang et al. | |
| D690,339 | S | 9/2013 | Sigmund | |
| D703,717 | S | 4/2014 | Williams | |
| 9,530,290 | B2 * | 12/2016 | Hutchinson | G08B 5/36 |
| 9,823,665 | B2 * | 11/2017 | Finnell | B67D 7/342 |
| 10,787,358 | B2 * | 9/2020 | Dudley | B67D 7/72 |
| 2001/0017349 | A1 | 8/2001 | Hoizapfel et al. | |
| 2003/0209280 | A1 | 11/2003 | Zerangue, Sr. | |
| 2014/0129038 | A1 | 5/2014 | Finnell et al. | |
| 2018/0004233 | A1 | 1/2018 | Lin et al. | |

FOREIGN PATENT DOCUMENTS

| | | | | |
|---|---|---|---|---|
| EP | 0697370 | | 2/1996 | |
| EP | 1050753 | | 11/2000 | |
| EP | 1354847 | | 10/2003 | |
| GB | 2401975 | | 11/2004 | |
| GB | 2401975 | A * | 11/2004 | B60K 15/04 |
| GB | 2466719 | | 7/2010 | |
| JP | 604844 | | 1/1985 | |
| JP | 01145550 | | 6/1987 | |
| JP | 07242144 | | 9/1995 | |
| JP | 08002595 | | 1/1996 | |
| JP | 2008107098 | | 5/2008 | |
| WO | 9615064 | | 5/1996 | |
| WO | 9820342 | | 5/1998 | |
| WO | 2007003860 | | 1/2007 | |
| WO | 2012052752 | | 4/2012 | |
| WO | 2013083792 | | 6/2013 | |

OTHER PUBLICATIONS

Combined United Kingdom Search and Examination Report corresponding to British Patent Application No. 1802544.5 (5 pages) (dated Jul. 3, 2018).

United Kingdom Search Report corresponding to British Patent Application No. 1017493.6 (2 pages) (dated Feb. 15, 2011).

International Search Report and the Written Opinion of the International Searching Authority corresponding to International Patent Application No. PCT/GB2011/05214 (26 pages) (dated Apr. 12, 2012).

United Kingdom Department for Business Innovation & Skills (BIS) Certification for Fuelomat Fuel Management System (14 pages) (dated Mar. 10, 2011).

* cited by examiner (c)

(b)

(a)

FUEL DELIVERY SPOUT FOR AVOIDING MISFUELLING AND METHOD THEREFOR

The content of patent application WO2012/052752 is hereby incorporated by reference.

FIELD OF THE INVENTION

The present invention relates to apparatus for use in delivering fuel to a fuel storage tank at a fuel storage facility and to a method of delivering fuel.

BACKGROUND

It is known to provide apparatus for delivering fuel to a storage tank. For example, fuel delivery vehicles (known as fuel tankers) having fuel storage tanks may be used to deliver fuel from refineries to refuelling stations for sale to consumers.

Currently there are two primary fuel types used to power vehicles on public roads. They are petroleum spirits (commonly referred to as 'petrol' or 'gasoline') and diesel oil ('diesel'). Vehicles configured to operate using one fuel can experience damage if supplied with the other fuel. Thus it is important to avoid contaminating a petrol storage tank and related equipment with diesel or a diesel storage tank and related equipment with petrol.

It is not uncommon for a driver of a fuel tanker inadvertently to load the wrong type of fuel into a filling station fuel storage tank, for example diesel oil into a tank containing petrol, thereby contaminating the tank. This may be referred to in the industry as a 'misfuelling event', a 'misfuel' or 'cross-contamination'. Cross-contamination can be costly in terms of time and money to rectify due to wastage of fuel and cleaning of the contaminated tank. Furthermore, as noted above, damage can occur to vehicles and equipment contaminated with the wrong fuel type.

It is an aim of embodiments of the present invention to at least partially mitigate the disadvantages of known refuelling apparatus.

STATEMENT OF THE INVENTION

Embodiments of the invention may be understood by reference to the appended claims.

In an aspect of the invention for which protection is sought there is provided apparatus comprising:

- a fluid inlet for coupling to a fluid source, a fluid outlet for coupling to a fluid storage tank inlet and a conduit disposed therebetween;
- fluid inspection means for inspecting a fluid within the conduit, the inspection means being configured to provide an output indicative of a type of fluid in the conduit;
- valve means operable selectively to prevent or allow flow of fluid through the conduit from the fluid inlet to the fluid outlet; and
- control means configured automatically to cause the valve means to prevent or allow flow of fluid through the conduit in dependence on the output of the fluid inspection means and permitted fluid information, being information indicative of a type of fluid that is to be permitted to flow through the conduit,
- the apparatus comprising electricity generating means configured to generate electrical power to charge a charge storage device, the charge storage device being arranged to provide a supply of electrical power for the apparatus.

The permitted fluid information may be information substantially permanently stored in the apparatus. Alternatively, the permitted fluid information may be information received by the apparatus via input means such as by means of one or more switches on the apparatus, via a radio receiver, bar code reader or any other suitable input means.

In an aspect of the invention for which protection is sought there is provided a fuel filling apparatus comprising:

- a fluid inlet for coupling to a fluid source, a fluid outlet for coupling to a fluid storage tank inlet and a conduit disposed therebetween;
- fluid inspection means for inspecting a fluid within the conduit, the inspection means being configured to provide an output indicative of a type of fluid in the conduit;
- valve means operable selectively to prevent or allow flow of fluid through the conduit from the fluid inlet to the fluid outlet;
- input means for receiving permitted fluid information being information indicative of a type of fluid that is to be permitted to flow through the conduit; and
- control means configured automatically to cause the valve means to prevent or allow flow of fluid through the conduit in dependence on the output of the fluid inspection means and the permitted fluid information received by the input means,
- the apparatus comprising electricity generating means configured to generate electrical power to charge a charge storage device, the charge storage device being arranged to provide a supply of electrical power for the apparatus.

The generating means may comprise an electrical generator configured to generate electrical power to charge a charge storage device in response to flow of fluid through the apparatus during a fuel filling operation in which fluid flows from the fluid source to the fluid storage tank via the conduit, the charge storage device being arranged to provide a supply of electrical power for the apparatus.

Alternatively or in addition the generating means may comprising means for generating electricity from sunlight, such as a solar panel, optionally a photovoltaic solar panel.

In an aspect of the invention for which protection is sought there is provided apparatus, optionally a fuel filling apparatus, comprising:

- a fluid inlet for receiving fluid from a fluid source, a fluid outlet, optionally for coupling to a fluid receiving inlet, optionally a fuel storage tank inlet, and a conduit disposed therebetween;
- fluid inspection means for inspecting a fluid within the conduit, the inspection means being configured to provide an output indicative of a type of fluid in the conduit;
- valve means operable selectively to prevent or allow flow of fluid through the conduit from the fluid inlet to the fluid outlet; and
- control means configured automatically to cause the valve means to prevent or allow flow of fluid through the conduit in dependence on the output of the fluid inspection means and permitted fluid information being information indicative of a type of fluid that is to be permitted to flow through the conduit,
- the apparatus comprising an electrical generator configured to generate electrical power to charge a charge storage device in response to flow of fluid through the apparatus during an operation in which fluid flows from the fluid inlet to the fluid outlet via the conduit, the charge storage device being arranged to provide a supply of electrical power for the apparatus.

In some embodiments the apparatus may be referred to as a fluid delivery apparatus. In some embodiments the apparatus may be referred to as fluid filling apparatus. In some embodiments the apparatus may be referred to as fuel delivery or fuel filling apparatus.

In some embodiments the apparatus may be used for delivering fluid such as fuel to a fluid storage tank.

The feature that the apparatus is capable of generating electrical power when it is used has the advantage that the apparatus need not be charged by an external power source between uses, or have the charge storage device replaced as often as might otherwise be required. It is to be understood that some valve means such as electrically actuated valve means may draw relatively large currents in order to effect opening closing of the valve means. A charge storage device such as a battery or battery pack may therefore be drained relatively quickly when the apparatus is used.

The ability of the apparatus to generate charge for storage in the charge storage device is advantageous because, in some embodiments, a smaller and lighter charge storage device may be employed, since the charge storage device does not have to be capable of opening and closing the valve means a relative large number of times before it is recharged or replaced.

Furthermore, in some embodiments the apparatus may be employed in a hazardous environment in which replacement of a charge storage device is difficult or prohibited. Accordingly, in some applications, it may be necessary to return the apparatus to a service facility for replacement of the charge storage device. By providing integral recharging functionality by means of the electrical generator with a turbine, the service interval may be extended substantially.

Optionally, the fluid outlet is suitable for coupling to the fluid receiving inlet of a fluid storage tank.

Optionally, the apparatus may be portable, the apparatus being configured to be removably attachable to a fluid storage tank inlet. Alternatively, the apparatus may be arranged to be fixed substantially permanently to the fluid storage tank inlet.

It is to be understood that at least one of the fluid inspection means, valve means, input means and control means is electrically powered. In some embodiments, each of the fluid inspection means, valve means, input means and control means are electrically powered.

Optionally, the electrical generator comprises a turbine element arranged to be driven by a flow of fluid through the apparatus, in use, thereby to cause the generator to generate electrical power.

The electrical generator may, in some embodiments, generate around 100 mA of current as fluid flows through the apparatus. In the case of use of apparatus according to an embodiment of the invention as fuel filling or fuel delivery apparatus, in some example scenarios a fuel filling operation may take around 3-7 minutes with a flow rate of around 1000 litres per minute of liquid through the fuel filling apparatus. In some embodiments, this may enable sufficient electrical power to be generated to power the apparatus for substantially an entire cycle of the delivery of fuel to a fuel storage tank, from initial connection and switching on of the apparatus to switching off once delivery is complete, with substantially no net drop in the level of charge in a battery power source comprised by the apparatus in some embodiments, and recharged by the generator.

It is to be understood that the electrical generator may comprise an electric machine having a drive shaft, the electric machine being configured to generate electrical power when the drive shaft is caused to rotate.

Optionally, an axis of rotation of the turbine element is substantially parallel to a direction of flow of fluid through the conduit of the apparatus.

Optionally, a diameter of the turbine element is substantially equal to a diameter of the conduit.

Optionally, the turbine element is provided substantially within the conduit.

Optionally, substantially all fluid flowing through the conduit impinges on the turbine element thereby to promote rotation of the turbine element.

Optionally, at least a portion of the conduit substantially immediately downstream of the turbine element, with respect to a direction of flow of fluid through the apparatus from the inlet to the outlet, is of substantially the same diameter as the turbine element or of a smaller diameter than the turbine element.

This feature has the advantage that substantially all fluid flowing through the conduit impinges on the turbine element thereby to promote rotation of the turbine element.

Optionally, the apparatus comprises input means for receiving the permitted fluid information.

Optionally, the input means comprises a radio frequency signal (radio) receiver.

Optionally, the input means comprises a radio frequency identification (RFID) tag reader, the tag reader comprising the radio receiver.

Optionally, the input means is configured to receive the fluid information and in addition information indicative of the identity of a storage tank to which the apparatus is coupled, the apparatus being configured to store the information indicative of tank identity and the permitted fluid information for that tank. The apparatus may be arranged to be substantially permanently coupled to an inlet of the storage tank. Alternatively, the apparatus may be configured to be releasably coupled, for example by means of a quick release mechanism, for example by means of a lever mechanism, clasp or clamp mechanism or any other suitable mechanism.

In some embodiments the input means may comprise means switch means such as one or more switches that enable the fluid type to be set, the apparatus being arranged to determine the permitted fluid information based on the state of a switch or by determining which one or a plurality of input buttons has been pressed. Optionally, the switch means may be inaccessible to an operator. The switch means may be provided behind a panel, optionally a tamper evident panel or a panel requiring a key or specialist tool to access.

Optionally, the control means is further configured to communicate with a fluid level monitoring system and receive fill level information indicative of a level of fluid in a fluid storage tank.

Optionally, the control means is configured to communicate with the fluid level monitoring system and receive fill level information indicative of the level of fluid in the fluid storage tank to which the apparatus is connected based on the information indicative of the identity of the storage tank to which the apparatus is coupled.

Optionally, the control means is configured to automatically cause the valve means to prevent flow of fluid through the conduit if the fill level information indicates the fill level is at least at a predetermined shut-off level.

Optionally, the control means is configured automatically to provide an alert to an operator if the fill level information indicates the fill level is at least at a predetermined alert level.

Optionally, the predetermined alert level is less than the predetermined shut-off level.

Optionally, the apparatus is configured to communicate with the fluid level monitoring system by means of a wireless link. The fluid level monitoring system may be provided by an automatic tank gauging (ATG) system, for example located at a fuel filling station where the apparatus may be being employed for fuel tank filling.

Optionally, the valve means comprises an electrically actuated valve.

The apparatus may have a display panel, optionally a liquid crystal display (LCD) panel. The panel may be backlit. The panel may provide instructions to an operator of the apparatus. The panel may display status information regarding the apparatus, such as a state (open or closed) of the valve means.

Optionally, the fluid outlet is suitable for coupling to the fluid receiving inlet of a fluid storage tank.

Some embodiments of the invention are suitable for permanently or temporarily coupling in a fluid handling system. Some embodiments have the advantage that the apparatus may be may be self-powering in the system, which may enable it to be located in a hazardous environment or an environment in which a source of power is unavailable either permanently or periodically, for example due to planned or unplanned power outages.

Optionally, some embodiments of the apparatus may be described as a fuel filling elbow apparatus.

In a further aspect of the invention for which protection is sought there is provided a method of preventing an undesirable fluid from flowing into a fluid receiving inlet comprising by means of fluid inspection apparatus comprising:

coupling a fluid inlet of the fluid inspection apparatus to a fluid source;

causing fluid from the fluid source to enter a conduit of the apparatus;

inspecting the fluid in the conduit by means of inspection means comprised by the apparatus, the inspection means providing an output indicative of a type of fluid in the conduit to a control means;

receiving by means of an input means comprised by the apparatus permitted fluid information being information indicative of a type of fluid that is to be permitted to flow through the conduit;

automatically causing valve means, by means of the control means, to prevent or allow flow of fluid through the conduit in dependence on the output of the fluid inspection means and the permitted fluid information received by the input means; and generating, by means of an electrical generator, electrical power to charge a charge storage device in response to flow of fluid through the apparatus from the fluid source to the fluid receiving inlet via the conduit, the charge storage device providing a supply of electrical power for the apparatus.

In a further aspect of the invention for which protection is sought there is provided a method of preventing an undesirable fluid from flowing into a fluid receiving inlet comprising by means of fluid inspection apparatus comprising:

coupling a fluid inlet of the fluid inspection apparatus to a fluid source;

causing fluid from a fluid source to enter a conduit of the apparatus via a fluid inlet of the apparatus;

inspecting the fluid in the conduit by means of inspection means comprised by the apparatus, the inspection means providing an output indicative of a type of fluid in the conduit to a control means;

automatically causing valve means, by means of the control means, to prevent or allow flow of fluid through the conduit in dependence on the output of the fluid inspection means and permitted fluid information being information indicative of a type of fluid that is to be permitted to flow through the conduit; and generating, by means of an electrical generator, electrical power to charge a charge storage device in response to flow of fluid through the apparatus from the fluid source to the fluid receiving inlet via the conduit, the charge storage device providing a supply of electrical power for the apparatus.

The method may comprise receiving the permitted fluid information by means of an input means comprised by the apparatus.

The method may comprise generating electrical power by causing a turbine element comprised by the apparatus to be driven by a flow of fluid through the apparatus.

Optionally, the apparatus is a portable fluid filling apparatus, the method comprising coupling a fluid outlet of the fluid filling apparatus to the fluid storage tank inlet.

Optionally, the apparatus is a portable fuel filling apparatus, the method comprising coupling a fluid outlet of the fuel filling apparatus to a fuel storage tank inlet.

The method may comprise causing a flow of fuel through the apparatus to the fuel storage tank inlet.

Thus, it is to be understood that a method according to some embodiments comprises generating electrical power by causing a turbine element comprised by the apparatus to be driven by a flow of fuel through the apparatus during a fuel filling operation in which fuel passes through the apparatus, optionally to a fuel storage tank, optionally an underground fuel storage tank.

In a further aspect of the invention for which protection is sought there is provided a method of preventing misfuelling by means of fuel filling apparatus, the method comprising:

coupling a fluid inlet of the fuel filling apparatus to a fluid source;

causing fluid from the fluid source to enter a conduit of the apparatus;

inspecting the fluid in the conduit by means of inspection means comprised by the apparatus, the inspection means providing an output indicative of a type of fluid in the conduit, the output optionally being to a control means comprised by the apparatus;

receiving by means of an input means comprised by the apparatus permitted fluid information being information indicative of a type of fluid that is to be permitted to flow through the conduit;

automatically causing, by means of the control means, the valve means to prevent or allow flow of fluid through the conduit in dependence on the output of the fluid inspection means and the permitted fluid information received by the input means; and generating, by means of an electrical generator, electrical power to charge a charge storage device in response to flow of fluid through the apparatus during a fuel filling operation in which fluid flows from the fluid source to the fluid storage tank via the conduit, the charge storage device providing a supply of electrical power for the apparatus.

The method may comprise generating electrical power by causing a turbine element comprised by the apparatus to be driven by a flow of fluid through the apparatus during a fuel filling operation in which fuel passes through the apparatus.

Optionally, the apparatus is a portable fuel filling apparatus, the method comprising coupling a fluid outlet of the fuel filling apparatus to the fluid storage tank inlet.

In an aspect of the invention for which protection is sought there is provided fluid filling apparatus comprising:

- a fluid inlet for coupling to a fluid source, a fluid outlet for coupling to a fluid storage tank inlet and a conduit disposed therebetween;
- fluid inspection means for inspecting a fluid within the conduit, the inspection means being configured to provide an output indicative of a type of fluid in the conduit;
- valve means operable selectively to prevent or allow flow of fluid through the conduit from the fluid inlet to the fluid outlet;
- input means for receiving permitted fluid information associated with the fluid storage tank inlet to which the apparatus is coupled, being information indicative of a type of fluid that is to be permitted to flow through the conduit to the fluid storage tank inlet; and
- control means configured automatically to cause the valve means to prevent or allow flow of fluid through the conduit in dependence on the output of the fluid inspection means and the permitted fluid information received by the input means.

The apparatus may comprise liquid presence determining means for determining whether liquid is present in the conduit of the apparatus.

It is to be understood that the liquid presence determining means may comprise a separate liquid presence sensor. Alternatively, the fluid inspection means may be configured to determine whether liquid is present in the conduit, providing the liquid presence determining means.

Optionally, the apparatus is configured to receive fresh permitted fluid information via the input means once it is has been determined that liquid is present in the conduit by means of the liquid presence determining means.

Optionally, the apparatus is configured to receive fresh permitted fluid information via the input means once it is has been determined that fluid in the conduit corresponds to the permitted fluid information previously received, the control means being configured automatically to cause the valve means to prevent or allow flow of fluid through the conduit in dependence on the output of the fluid inspection means and the freshly received permitted fluid information received by the input means.

Thus, in the event that the fresh permitted fluid information corresponds to the output of the fluid inspection means, the control means causes the valve means to allow fluid flow therethrough.

Some embodiments of the present invention have the advantage that an accidental or intentional misfuelling event due to movement of the apparatus from the inlet of a first fluid storage tank to that of a second may be prevented. This is because, before causing the valve means to allow fluid flow therethrough, the apparatus receives fresh permitted fluid information and ensures that the output of the fluid inspection means matches the fresh permitted fluid information associated with the inlet of the fluid storage tank to which the apparatus is coupled. Thus, if after being coupled to a first fluid storage tank inlet the apparatus is subsequently moved to the inlet of a second fluid storage tank, the apparatus confirms that the output of the fluid inspection means matches the permitted fluid information associated with the second fluid storage tank before allowing the valve means to permit fluid flow therethrough, preventing a mis-delivery event in the event of a mismatch between fluid in the conduit of the apparatus and the permitted fluid information. The mis-delivery event may be a misfuelling event in the case of use of the apparatus to delivery fuel.

In some embodiments the apparatus is configured to receive, in advance of use, information indicative of the identity of one or more tanks or inlets and the type(s) of fluid that is (are) permitted to be dispensed into each of the one or more tanks or inlets.

The apparatus may be configured to receive information indicative of the identity of a tank or inlet to which the apparatus is connected and determine, from information stored by the apparatus, the identity of the fluid, such as a fuel, that it is permitted to deliver. In some embodiments the apparatus may be configured to access a remote data storage device such as a server, and obtain information in respect of the liquid that it is permitted to deliver to that inlet or tank.

Optionally the apparatus may be configured repeatedly to receive permitted fluid information via the input means when switched on.

The apparatus may be configured to repeatedly receive permitted fluid information and to compare the output of the fluid inspection means indicative of a type of fluid in the conduit with the permitted fluid information and to cause the valve means to prevent or allow flow of fluid through the conduit in dependence on the output of the fluid inspection means and the received permitted fluid information, optionally the most recently received permitted fluid information.

The apparatus may be configured to provide an output to an operator indicative of an identify of the permitted fluid corresponding to the permitted fluid information received.

In some embodiments, the apparatus is configured repeatedly to receive permitted fluid information for a predetermined time period following powering up of the apparatus. In some embodiments, the apparatus is configured repeatedly to receive permitted fluid information when switched on until the control means determines that the valve means may be opened.

The apparatus may be configured such that, when initially connected to a fluid tank inlet, or initially switched on, the apparatus receives permitted fluid information via the input means. The apparatus may provide an output corresponding to the permitted fluid information, for example by means of a visual output such as by illuminating a lamp corresponding to the permitted fluid or via a display such as a digital display, optionally a liquid crystal display (LCD) panel. This feature has the advantage that an operator can confirm that the fluid the apparatus is expecting corresponds to the fluid the operator intends to deliver. The apparatus may be configured to receive fresh permitted fluid information via the input means once it is has been determined (by reference to the fluid inspection means) that fluid in the conduit corresponds to the permitted fluid information initially received, the control means being configured automatically to cause the valve means to prevent or allow flow of fluid through the conduit in dependence on the output of the fluid inspection means and the freshly received permitted fluid information received by the input means.

In some embodiments the apparatus may continue to monitor the permitted fluid information via the input means whilst the valve means is permitting fluid flow therethrough, the apparatus being configured to cause the valve means to prevent fluid flow therethrough in the event that the input means indicates that the permitted fluid information has changed.

The apparatus may comprise an electrical generator configured to generate electrical power to charge a charge storage device, the charge storage device being arranged to provide a supply of electrical power for the apparatus. The electrical generator may generate charge in response to flow of fluid through the apparatus during a fuel filling operation in which fluid flows from the fluid source to the fluid storage tank via the conduit. The electrical generator may be provided in the form of an electric machine such as a dynamo or other generator, configured to generate electrical power in response to turning of a turbine or impeller driven by flow of fluid through the apparatus.

In a further aspect of the invention for which protection is sought there is provided a method of preventing misfuelling by means of portable fuel filling apparatus, the method comprising:

coupling a fluid outlet of a portable fuel filling apparatus to a fluid storage tank inlet;

coupling a fluid inlet of the apparatus to a fluid source;

causing fluid from the fluid source to enter a conduit of the apparatus;

inspecting the fluid in the conduit by means of inspection means comprised by the apparatus, the inspection means providing an output to a control means comprised by the apparatus indicative of a type of fluid in the conduit;

receiving by means of an input means comprised by the apparatus permitted fluid information being information indicative of a type of fluid that is to be permitted to flow through the conduit;

automatically causing, by means of the control means, the valve means to prevent or allow flow of fluid through the conduit in dependence on the output of the fluid inspection means and the permitted fluid information received by the input means; and generating, by means of an electrical generator, electrical power to charge a charge storage device in response to flow of fluid through the apparatus during a fuel filling operation in which fluid flows from the fluid source to the fluid storage tank via the conduit, the charge storage device providing a supply of electrical power for the apparatus.

The method may comprise generating electrical power by causing a turbine element comprised by the apparatus to be driven by a flow of fluid through the apparatus during a fuel filling operation in which fuel passes through the apparatus.

In a further aspect of the invention for which protection is sought there is provided a portable fuel filling apparatus comprising:

a fluid inlet for coupling to a fluid source, a fluid outlet for coupling to a fluid storage tank inlet and a conduit disposed therebetween;

fluid inspection means for inspecting a fluid within the conduit, the inspection means being configured to provide an output indicative of a type of fluid in the conduit;

valve means operable selectively to prevent or allow flow of fluid through the conduit from the fluid inlet to the fluid outlet; and control means configured automatically to cause the valve means to prevent or allow flow of fluid through the conduit in dependence on the output of the fluid inspection means and permitted fluid information, the permitted fluid information being information indicative of a type of fluid that is to be permitted to flow through the conduit, the apparatus comprising an electrical generator configured to generate electrical power to charge a charge storage device in response to flow of fluid through the apparatus during a fuel filling operation in which fluid flows from the fluid source to the fluid storage tank via the conduit, the charge storage device being arranged to provide a supply of electrical power for the apparatus.

The permitted fluid information may be stored in a memory of the apparatus such as a memory of the control means.

It is to be understood that the permitted fluid information may be substantially permanently stored by the apparatus, the apparatus being configured to only permit a certain type of fluid to flow therethrough. For example, the apparatus may permit only a predetermined diesel fuel to pass therethrough, or only a predetermined unleaded petrol fuel to pass therethrough.

Optionally, the apparatus may comprise input means for receiving the permitted fluid information. The input means may comprise a radio receiver, optionally an RFID receiver arranged to read an RFID tag carrying the permitted fuel information. The apparatus may require the input means to receive permitted fluid information each time the apparatus is employed in a fuel filling operation, for example each time the apparatus is connected by an operator to a fuel inlet in order to enable a fuel filling operation.

In some embodiments the apparatus may have a switch that allows an operator to select the type of fuel that the apparatus is to allow to pass therethrough, such as 'petrol' or 'diesel'. The switch may permit a particular grade of a diesel or petrol fuel to be selected, for example according to the fuel's octane rating.

In a still further aspect of the invention for which protection is sought there is provided a method of preventing misfuelling by means of portable fuel filling apparatus, the method comprising:

coupling a fluid outlet of a portable fuel filling apparatus to a fluid storage tank inlet;

coupling a fluid inlet of the apparatus to a fluid source;

causing fluid from the fluid source to enter a conduit of the apparatus;

inspecting the fluid in the conduit by means of inspection means comprised by the apparatus, the inspection means providing an output to a control means comprised by the apparatus indicative of a type of fluid in the conduit;

automatically causing, by means of the control means, the valve means to prevent or allow flow of fluid through the conduit in dependence on the output of the fluid inspection means and permitted fluid information being information indicative of a type of fluid that is to be permitted to flow through the conduit; and generating, by means of an electrical generator, electrical power to charge a charge storage device in response to flow of fluid through the apparatus during a fuel filling operation in which fluid flows from the fluid source to the fluid storage tank via the conduit, the charge storage device providing a supply of electrical power for the apparatus.

The method may comprise receiving the permitted fluid information by means of input means of the apparatus.

The input means may comprise a radio receiver, optionally an RFID receiver arranged to read an RFID tag carrying the permitted fuel information.

In one aspect of the invention for which protection is sought there is provided a portable fuel filling apparatus comprising:

a fluid inlet for coupling to a fluid source, a fluid outlet for coupling to a fluid storage tank inlet and a conduit disposed therebetween;

fluid inspection means for inspecting a fluid within the conduit, the inspection means being configured to provide an output indicative of a type of fluid in the conduit;

valve means operable selectively to prevent or allow flow of fluid through the conduit from the fluid inlet to the fluid outlet;

input means for receiving permitted fluid information being information indicative of a type of fluid that is to be permitted to flow through the conduit; and control means configured automatically to cause the valve means to prevent or allow flow of fluid through the conduit in dependence on the output of the fluid inspection means and the permitted fluid information received by the input means, the input means comprising a radio receiver.

Optionally, the input means comprises a radio frequency identification (RFID) tag reader, the tag reader comprising the radio receiver.

The tag reader may be arranged to read active and/or passive RFID tags.

Optionally, the input means is configured to receive the fluid information and in addition information indicative of the identity of a storage tank to which the apparatus is coupled, the apparatus being configured to store the information indicative of tank identity and the permitted fluid information for that tank.

Optionally, the control means is further configured to communicate with a fluid level monitoring system and receive fill level information indicative of a level of fluid in a fluid storage tank.

Optionally, the control means is configured to communicate with the fluid level monitoring system and receive fill level information indicative of the level of fluid in the fluid storage tank to which the apparatus is connected based on the information indicative of the identity of the storage tank to which the apparatus is coupled.

Optionally, the control means is configured to automatically cause the valve means to prevent flow of fluid through the conduit if the fill level information indicates the fill level is at least at a predetermined shut-off level.

Optionally, the control means is configured automatically to provide an alert to an operator if the fill level information indicates the fill level is at least at a predetermined alert level.

Optionally, the predetermined alert level is less than the predetermined shut-off level.

Optionally, the apparatus is configured to communicate with the fluid level monitoring system by means of a wireless link.

The wireless link may be a wireless radio link. Other wireless links may be useful in some embodiments.

Optionally, the apparatus may comprise an electrical generator configured to generate electrical power to charge a charge storage device in response to flow of fluid through the apparatus.

Optionally, the electrical generator comprises a turbine element arranged to be exposed to flow of fluid through the apparatus in use.

Optionally, the valve means comprises an electrically actuated valve.

In a further aspect of the invention for which protection is sought there is provided a method of preventing misfuelling by means of portable fuel filling elbow apparatus, the method comprising:

coupling a fluid outlet of a portable fuel filling elbow apparatus to a fluid storage tank inlet;

coupling a fluid inlet of the elbow apparatus to a fluid source;

causing fluid from the fluid source to enter a conduit of the apparatus;

inspecting the fluid in the conduit by means of inspection means comprised by the apparatus, the inspection means providing an output to a control means comprised by the apparatus indicative of a type of fluid in the conduit;

receiving by means of a radio receiver of an input means comprised by the apparatus permitted fluid information being information indicative of a type of fluid that is to be permitted to flow through the conduit; and automatically causing, by means of the control means, the valve means to prevent or allow flow of fluid through the conduit in dependence on the output of the fluid inspection means and the permitted fluid information received by the input means.

In another aspect of the invention for which protection is sought there is provided a portable fuel filling elbow apparatus comprising:

a fluid inlet for coupling to a fluid source, a fluid outlet for coupling to a fluid storage tank inlet and a conduit disposed therebetween;

valve means operable selectively to prevent or allow flow of fluid through the conduit from the fluid inlet to the fluid outlet;

input means for receiving information indicative of a level of fuel in the storage tank; and control means configured automatically to cause the valve means to prevent or allow flow of fluid through the conduit in dependence on the level of fuel in the storage tank.

Optionally, the input means is configured to receive the information indicative of the level of fuel in the storage tank from tank gauging apparatus, optionally automatic tank gauging (ATG) apparatus. The input means may receive the information indicative of the level of fuel in the storage tank by means of a wireless communications link, optionally a wireless radio communications link.

In some embodiments, the portable fuel filling elbow apparatus may be provided without the fluid inspection means for inspecting fluid within the conduit.

Some embodiments of the present invention provide a portable fuel filling apparatus comprising: a fluid inlet for coupling to a fluid source, a fluid outlet for coupling to a fluid storage tank inlet and a conduit disposed therebetween; fluid inspection means for inspecting a fluid within the conduit, the inspection means being configured to provide an output indicative of a type of fluid in the conduit; valve means operable selectively to prevent or allow flow of fluid through the conduit from the fluid inlet to the fluid outlet; input means for receiving permitted fluid information being information indicative of a type of fluid that is to be permitted to flow through the conduit; and control means configured automatically to cause the valve means to prevent or allow flow of fluid through the conduit in dependence on the output of the fluid inspection means and the permitted fluid information received by the input means, the apparatus comprising an electrical generator configured to generate electrical power to charge a charge storage device in response to flow of fluid through the apparatus during a fuel filling operation in which fluid flows from the fluid source to the fluid storage tank via the conduit, the charge storage device being arranged to provide a supply of electrical power for the apparatus.

BRIEF DESCRIPTION OF THE DRAWINGS

Embodiments of the invention will now be described with reference to the accompanying figures in which.

DETAILED DESCRIPTION

Figure 1:
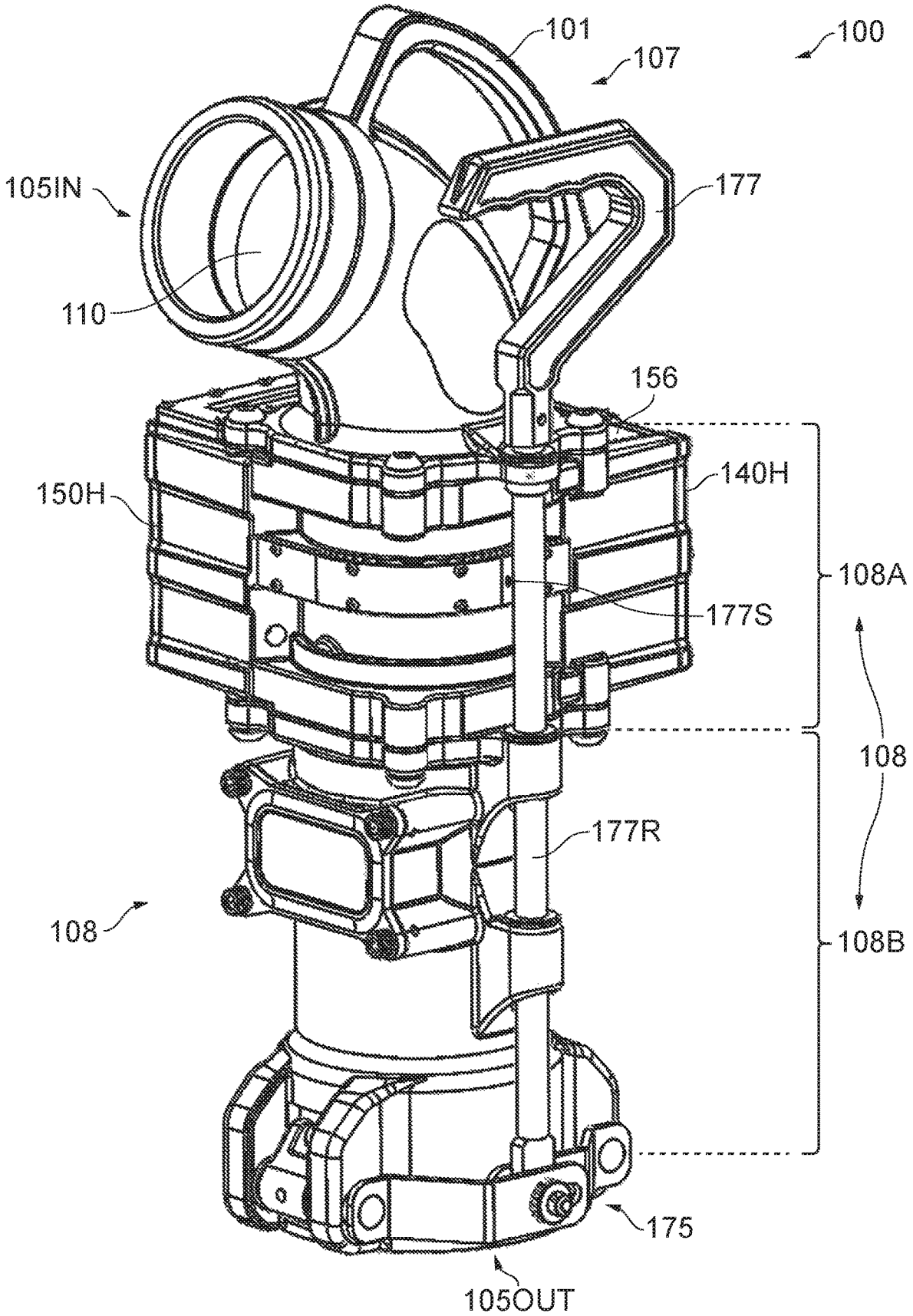
FIG. 1 is a perspective view of a portable fuel filling apparatus according to an embodiment of the invention.
Figure 2:
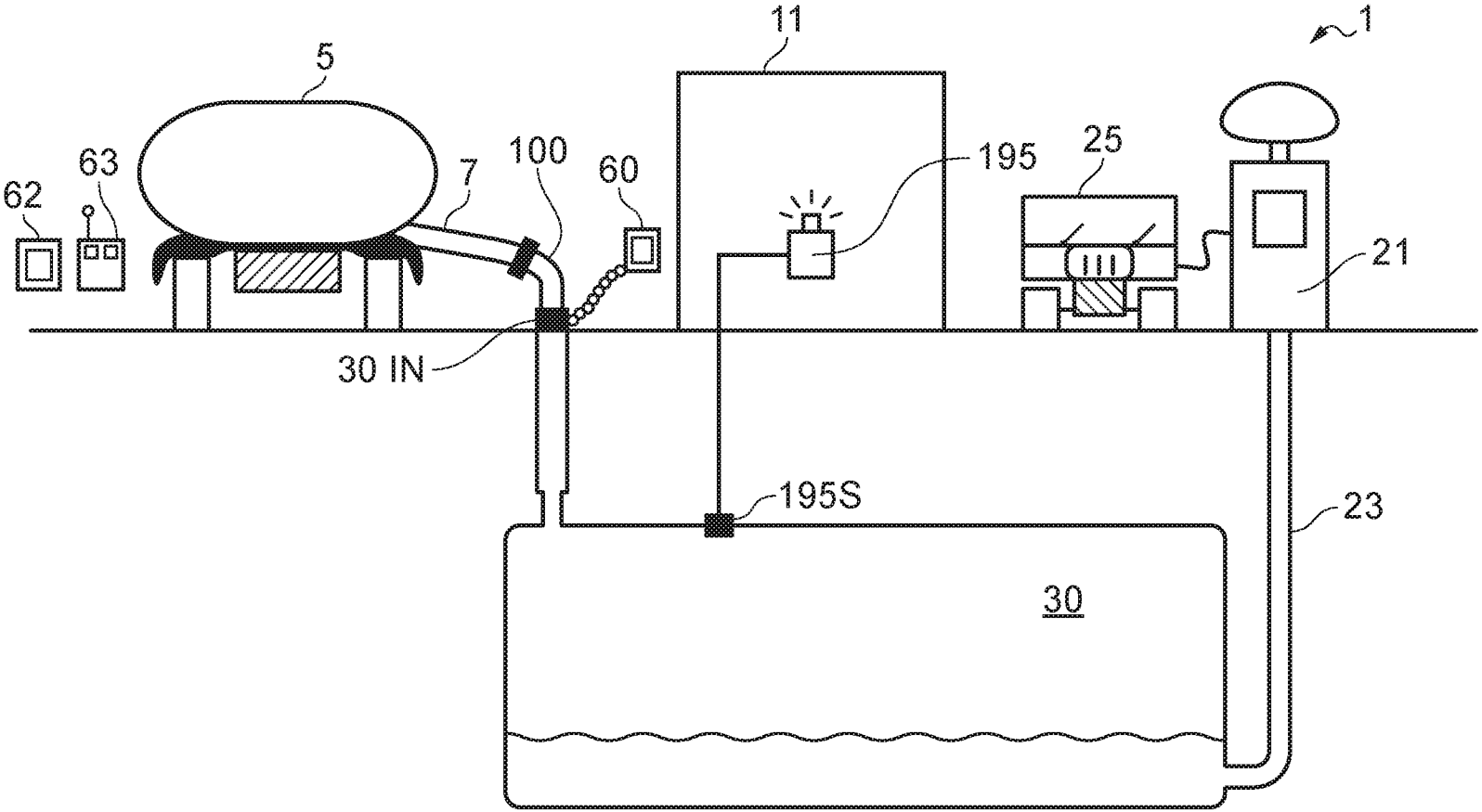
FIG. 2 is a schematic illustration of the apparatus of FIG. 1 coupled to the inlet of an underground fuel storage tank of a filling station

FIG. 1 shows a portable fuel filling apparatus 100 according to an embodiment of the present invention for use when transferring fuel from a fuel tanker vehicle 5 to an underground fuel storage tank 30 of a filling station 1 as illustrated schematically in FIG. 2.

FIG. 2 shows the apparatus 100 coupling a hose 7 connecting a fuel reservoir of a fuel tanker vehicle 5 to the inlet 30IN of an underground storage tank 30. Also shown in FIG. 2 is a vehicle 25 receiving fuel from a fuel pump 21 configured to draw fuel from the underground storage tank via a supply pipe 23.

As shown in FIG. 1, the apparatus 100 has a fluid inlet 105IN, a fluid outlet 105OUT and a fluid conduit 110 disposed therebetween, providing a flowpath for fluid from the inlet 105IN to the outlet 105OUT. The outlet 105OUT is arranged to be coupled to an inlet 30IN of the underground fuel storage tank 30 (FIG. 2). The apparatus 100 is attached to the inlet 30IN by means of a known clamp arrangement 175 employed in known fuel filling apparatus and which is operated by means of a handle 177 as shown in FIG. 1. The handle 177 is movable upwards and downwards with respect to the normal upright orientation of FIG. 1 in order to clamp the apparatus 100 to the inlet 30IN (by moving the handle 177 downwards) or release the apparatus from the inlet 30IN (by moving the handle 177 upwards).

Figure 3:
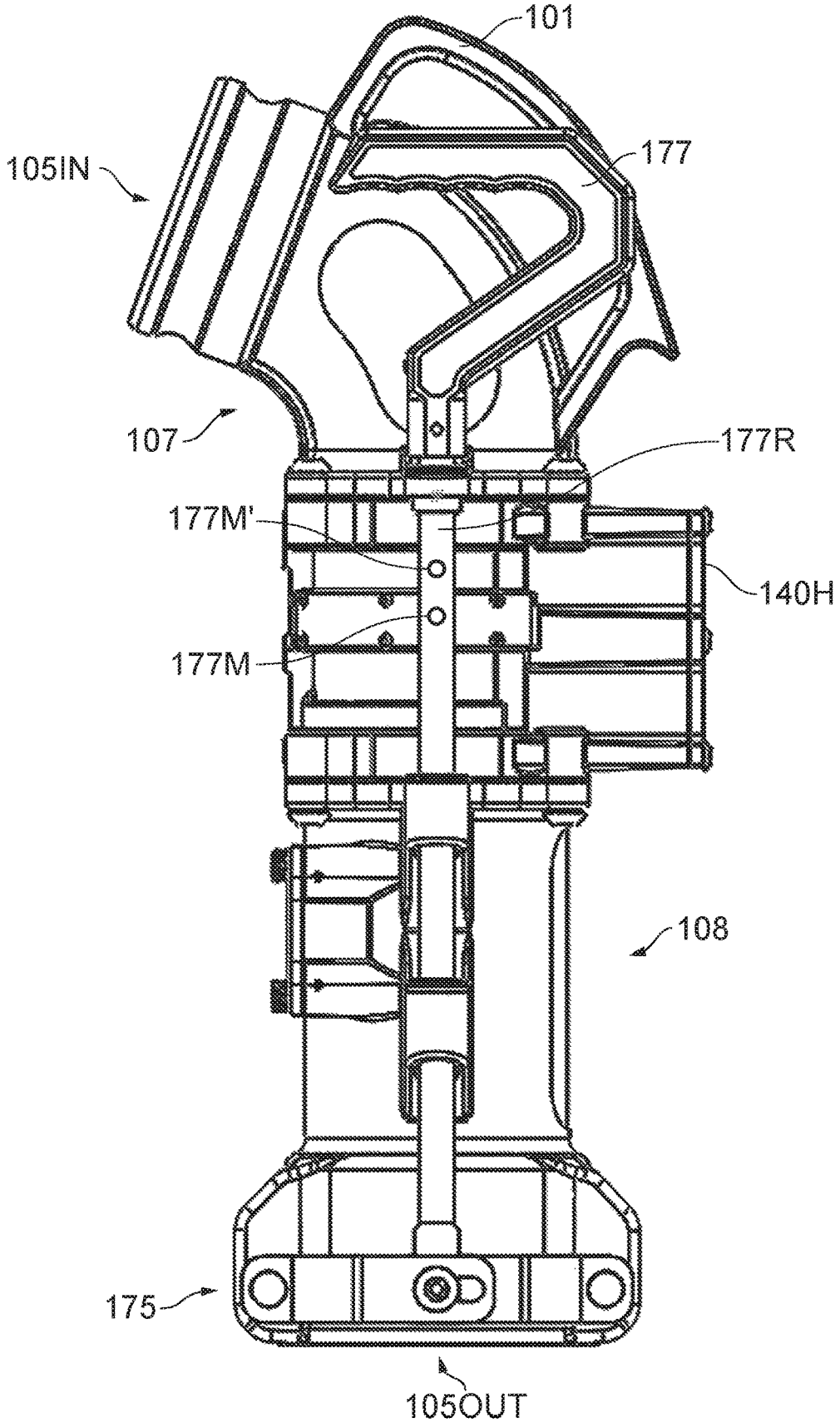
FIG. 3 is a side view of the apparatus of FIG. 1.

With respect to the normal in-use orientation illustrated in FIG. 1 and the side view of FIG. 3, the apparatus 100 has an upper inlet portion 107 in which the conduit 110 bends through an angle of substantially 50 degrees in the embodiment shown, although other angles such as 30 degrees, 40 degrees, 45 degrees, 60 degrees or any other suitable angle may be useful in some embodiments. The apparatus 100 also has an upright portion 108 below the inlet portion 107 in which the conduit 110 is substantially straight. In some embodiments, the upper portion 107 is also substantially straight, i.e. the bend angle is substantially zero. The inlet portion 107 of the embodiment of FIG. 1 may also be referred to as an 'elbow' portion.

Figure 4:
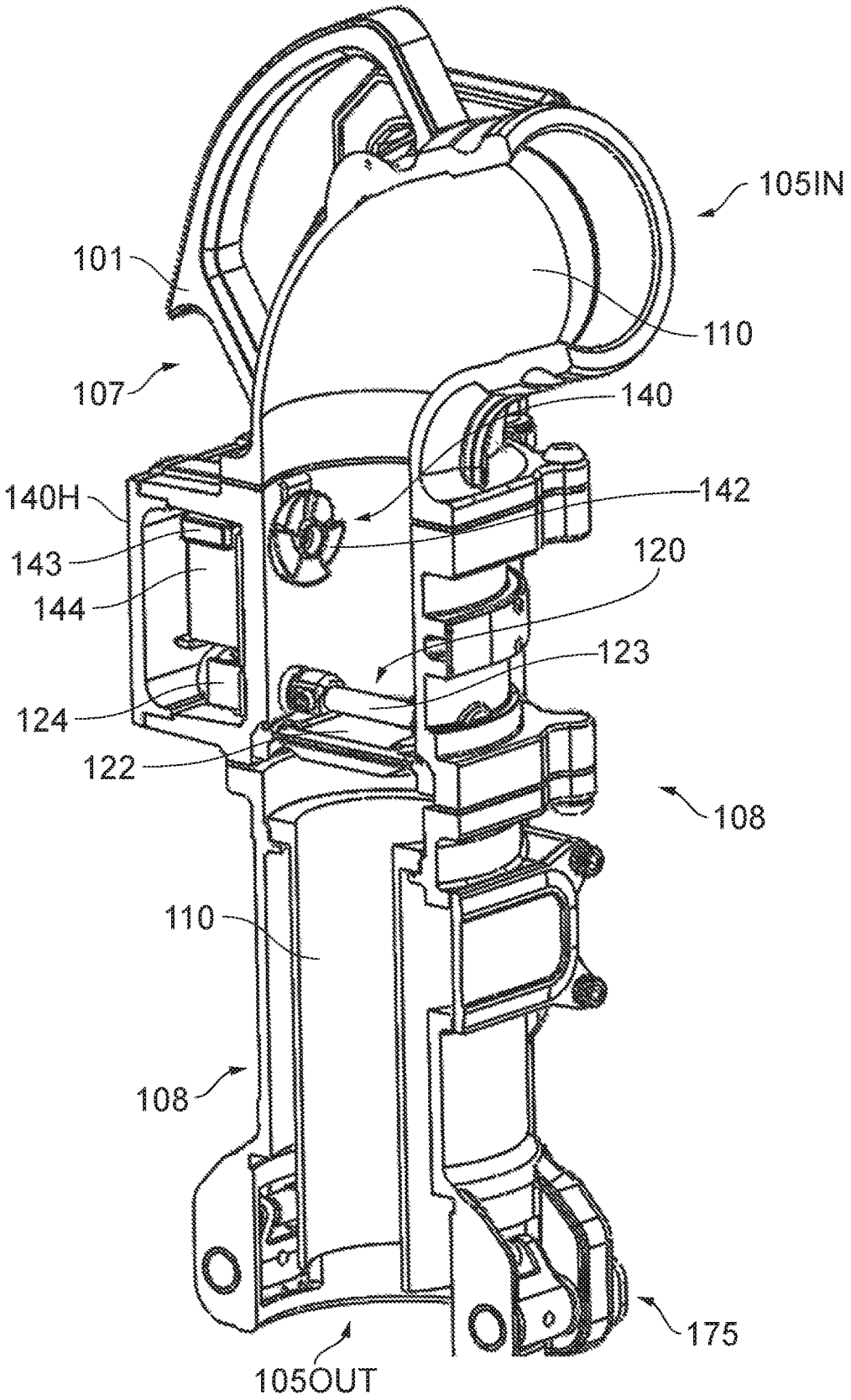
FIG. 4 is a cross-sectional perspective view of the apparatus of FIG. 1.

As shown in FIG. 1 and FIG. 4, a first (upper) portion 108A of the upright portion 108 includes valve means in the form of a valve device 120, a housing 150H of control means in the form of a control portion 150 (FIG. 5) and a housing 140H of a charging module 140. The control portion 150 is electrically activated ("switched on") when the handle 177 is translated to the "locked" position, in which the apparatus 100 becomes clamped to the inlet 30IN of the storage tank inlet in the conventional manner. FIG. 1 and FIG. 3 show the apparatus 100 with the handle 177 in the locked position, which corresponds to the fully 'down' position.

The handle 177 is coupled to a rod or shaft 177R of circular section that connects the handle 177 to the known clamp arrangement 175. A magnet 177M is coupled to the shaft 177R at a position of the shaft 177R facing the upper portion 108A of the apparatus 100. The magnet is shown at 177M in FIG. 3, however it is to be understood that in the present embodiment the magnet 177M would not be visible from the viewpoint of FIG. 1 since it is located on an opposite (rear) side of the shaft 177R with respect to the viewpoint of FIG. 1. The position of the magnet 177M when the handle is in the unlocked (raised) position is shown at 177M' in FIG. 1 (again, the magnet 177M being not visible in the view shown in FIG. 3).

The upper portion 108A of the apparatus 100 is provided with a magnetic switch 177S (FIG. 1) at a location of the shaft 177R such that the switch 177S is directly opposite the position of the magnet 177M when the handle 177 is in the locked position. The switch 177S is coupled to the control portion 150 and causes the control portion 150 to be powered (or 'powered up') when the handle 177 is moved from the raised to the lowered (unlocked to the locked) position and the magnet 177M is moved from the position shown at 177M' to the position shown at 177M. In the present embodiment the magnetic switch 177S is a 'reed'-type switch although other types of magnetic switch may be useful. It is to be understood that moving the handle 177 back to the unlocked position causes power supply to the control portion 150 to be terminated, i.e. the control portion 150 is 'powered down'.

When the control portion 150 initially receives power (is 'powered up') the control portion assumes a low power "sleep" mode, pending full activation as described further below.

Figure 5:
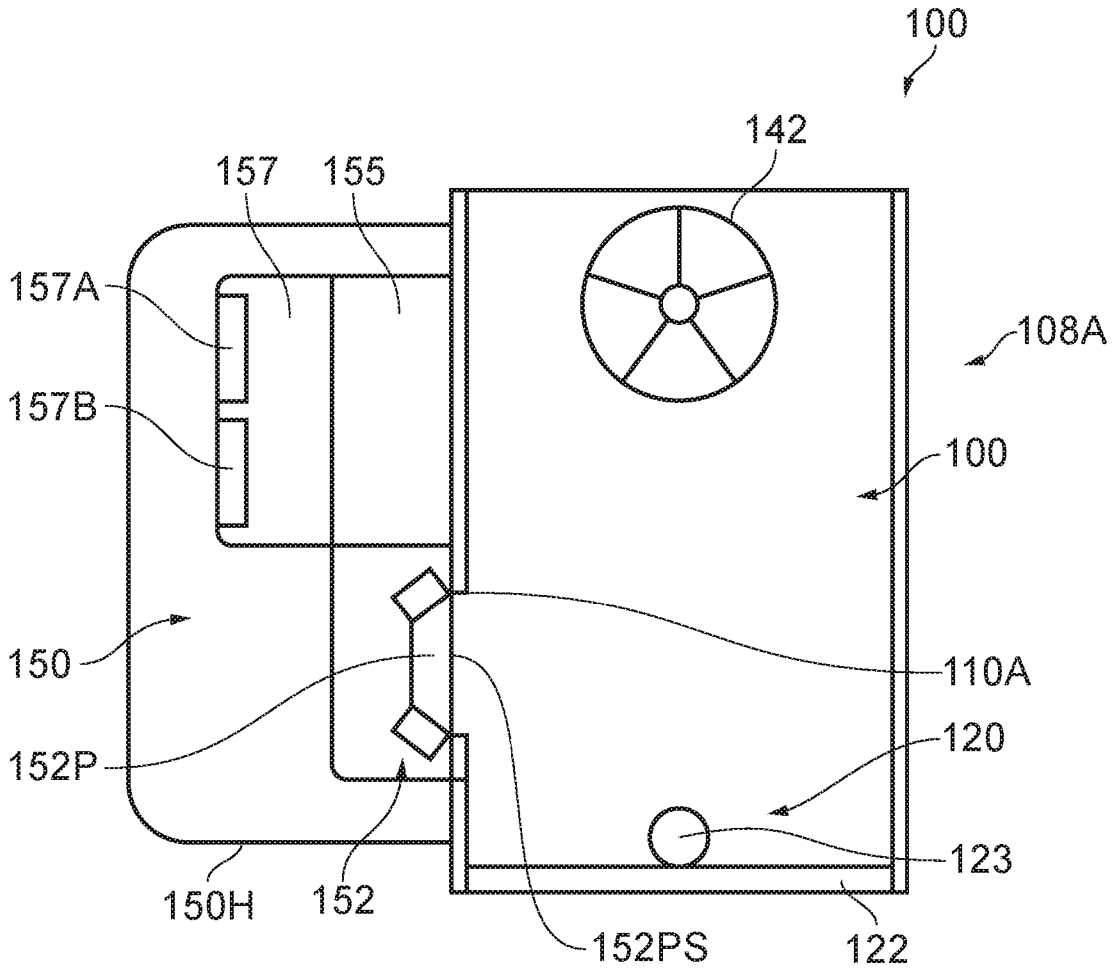
FIG. 5 is a schematic illustration of a control portion of the apparatus of FIG. 1.

The control portion 150 is illustrated in more detail in FIG. 5. The control portion 150 is provided within a housing 150H and includes a controller 155 and a fluid inspection sensor 152 providing fluid inspection means. The fluid inspection sensor 152 is configured to generate an output that is dependent on the type of fluid present in the region of the conduit 110 above the valve device 120 based on a refractive index of the fluid. The controller 150 is configured to determine, based on the output from the fluid sensor 152, whether any liquid in contact with the sensor 152 corresponds to the fuel within the fuel storage tank to which the fuel filling apparatus 100 is coupled. Further details of suitable sensor arrangements may be found in published patent application WO2012/052752, the content of which is incorporated herein by reference.

Figure 6:
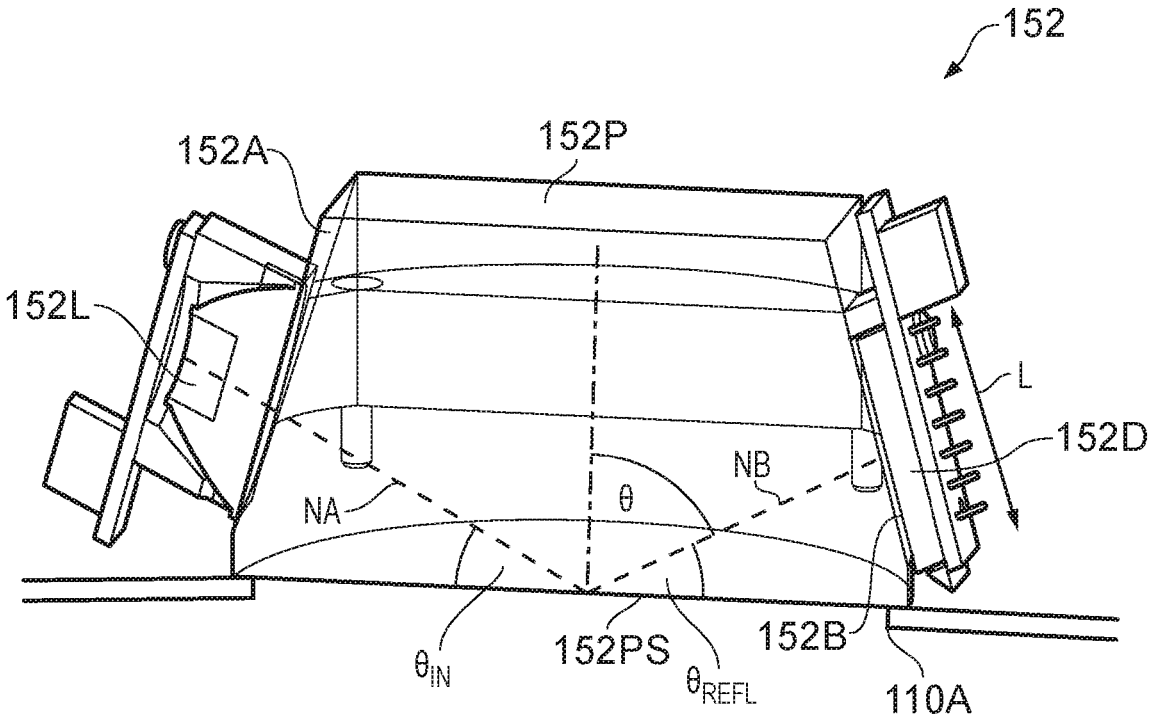
FIG. 6 is a schematic illustration of a fluid type sensor employed in the apparatus of FIG. 1.

As shown in FIG. 5 and FIG. 6, the fluid sensor 152 has a prism portion 152P having an exposure surface 152PS that covers an aperture 110A in the fluid conduit 110 of the apparatus 100 above the valve device 120. The exposure surface 152PS is thus exposed to any fluid present in the conduit 110 in the region above the valve device 120.

As shown in FIG. 6, the sensor 152 also has a light source 152L arranged to direct a beam of light through an entrance surface 152A of the prism portion 152P in a direction substantially normal to the entrance surface 152A, towards the exposure surface 152PS. An active light detector or sensor 152D is arranged to detect light from the source 152L that is reflected from the exposure surface 152PS and which passes through exit surface 152B. It is to be understood that the entrance and exit surfaces 152A, 152B are each inclined at an angle of substantially 70 degrees with respect to the exposure surface 152PS, in opposite directions, such that at least some light from the light source scattered by the exposure surface 152PS passes through the exit surface 152B. Other angles may be useful in some embodiments. The path of a beam of light through the prism portion 152P from the entrance surface 152A to the exposure surface 152PS is shown at NA, whilst the path of the ray following reflection at the exposure surface 152PS through an angle wherein the angle of incidence, $\theta_{IN}$, equals the angle of reflection, $\theta_{REFL}$, is shown at NB.

In the embodiment shown, the active detector 152D is a position sensitive detector in the form of a linear detector, providing an output indicative of the intensity of light falling on the detector 152D as a function of position along an active length L of the detector 152D. Detectors other than linear detectors may be useful in some embodiments.

As can be seen from FIG. 6, the longitudinal axis of the detector 152D (parallel to length L shown in FIG. 6) is oriented such that the detector 152D is able to detect an intensity of light falling on the detector 152D as a function of an angle through which the light has been scattered at the exposure surface 152PS. It is to be understood that, in the embodiment shown, the light source 152L may be arranged to direct light to be incident on the exposure surface 152PS over a non-zero range of angles such that light is scattered at the surface 152PS through a corresponding range of angles.

It is to be understood that the distribution of light intensity over the surface of the detector 152D is sensitive (responsive) to the type of fluid in contact with the exposure surface 152PS of the sensor 152, and in particular the refractive index of the fluid. A different distribution of light intensity is observed as a function of distance along the length of the detector 152D in dependence on whether the fluid is air, petrol or diesel, enabling the controller 150 to determine reliably whether or not a liquid is present in the fuel filling apparatus 100 above the valve 120, and whether any such liquid is petrol or diesel. It is to be understood that other types of sensor may be useful in some embodiments, including sensors responsive to a physical property other than refractive index such as ultrasonic sensors or any other suitable type of sensor. In some embodiments, liquid presence determining means in the form of a liquid presence sensor such as a capacitive liquid presence sensor, conductivity liquid presence sensor or any other suitable liquid presence sensor may be provided in addition. The controller 152 may employ the liquid presence sensor to confirm that liquid is present in the apparatus 100 above the valve 120. For example, in some embodiments the controller 152 may verify that liquid is present in the apparatus 100 above the valve 120, by reference to an output of the liquid presence sensor, before determining that a misfuel event has occurred if the controller 150 has determined, by reference to fluid sensor 152, that the fluid in contact with the sensor 152 is not a liquid corresponding to the liquid that is permitted to be delivered to the fuel storage tank 30.

The controller 155 includes a computing device arranged to compare data in respect of the intensity of light detected by the detector 152D with reference data stored in a memory of the controller 155 to determine whether the data corresponds to stored reference data in respect of air, petrol or diesel in order to determine the type of fluid in the conduit 110 (i.e. air, petrol or diesel). In some embodiments the controller 155 is arranged to determine the angle at which a peak in the intensity of scattered light is observed, or an angle that is offset from the angle of peak intensity by a prescribed amount, in order to determine whether the fluid is air, petrol or diesel.

It is to be understood that the sensor output is highly responsive to the fluid type, enabling reproducible and reliable determination of the type of fluid present in the conduit 110.

The controller 155 also receives an input from input means in the form of a communications module 157 that includes a radio frequency identification device (RFID) reader module 157A and a radio communications module 157B for communicating with an automatic tank gauging (ATG) control module 195 remote from the elbow apparatus 100 as shown in FIG. 2 and described in further detail below.

The RFID reader module 157A is configured to read an RFID tag 60 that is tethered to the inlet 30IN of the underground fuel storage tank 30 (as illustrated schematically in FIG. 2) in order to determine the type of fuel (petrol or diesel) that is stored in the storage tank 30.

As noted above, when the apparatus 100 is initially clamped to the tank inlet 30IN by actuation of handle 177 the control portion 150 is activated, i.e. switched 'on' or 'powered up'. The reader module 157A transmits a low power RF signal to excite a suitable passive RFID tag 60 and detect an RF signal transmitted by the tag 60 in response to excitation. When the RFID tag 60 is presented to the reader module 157A, the reader module 157A is able to read data stored by the tag 60 including data indicative of the identity of the tank (in the present embodiment a code indicative of the location of the tank at the filling station, such as a tank number) and the type of fuel stored in the tank 30. The reader module 157A outputs the information received from the tag 60 to the controller 155 which in turn stores this data in the memory of the controller 155.

In use, when the apparatus 100 has been initially clamped to the inlet 30IN of the storage tank 30 and switched from the 'off' condition to the 'on' condition or mode, the controller 155 provides an indication to an operator via a liquid crystal display (LCD) display device 156 (FIG. 1) that the RFID tag 60 associated with the storage tank should be presented to the apparatus 100 in order to enable the apparatus 100 to determine the type of fuel in the storage tank 30. The reader module 157A reads data stored in the RFID tag 60 as noted above and passes the information to the controller 155 which stores the type of fuel indicated on the tag 60, together with tank identity, in the memory of the controller 155. The controller 155 maintains valve device 120 in the closed condition until the controller 155 has read the tag 60. It is to be understood that the reader module 157A may read additional information from the tag 60 in some embodiments, such as data indicative of the location of the fuel filling station itself.

Once the tag has been read by the reader module 157A, the operator may then commence delivery of fuel from the tanker 5 (FIG. 2) via a delivery hose 7 to the fuel filling apparatus 100.

Once the controller 155 has read and stored fluid type data contained (i.e. stored) by the RFID tag 60, as described above, the controller 155 monitors the output of the fluid sensor 152 and compares the type of fluid detected by the sensor 152 with the fluid type read from the RFID tag 60. If the fluid types match, the controller 155 causes the valve device 120 to open, allowing fluid to flow past the valve device 120 to the fluid outlet 105OUT.

As shown in FIG. 4, the valve device 120 has a valve plate 122 that is arranged to block flow of liquid through the apparatus 100 when the valve is closed. The valve plate 122 is coupled to a drive shaft 123 that is rotatable by an electric motor 124. When it is required to open or close the valve, the motor 124 causes the drive shaft to rotate, causing the valve plate 122 in turn to rotate and open or close a flow path for fuel from the inlet 105IN to the outlet 105OUT of the apparatus 100.

If the fluid types do not match, the controller 155 causes the valve device 120 to remain in the closed position. It is to be understood that the apparatus 100 is configured to maintain the valve device 120 in the closed position unless a determination is made that the type of fluid in the conduit 110 matches that indicated on the RFID tag 60. In the present embodiment, if the controller 155 determines that a liquid is present that does not correspond to the fuel associated with the RFID tag 60, the controller 155 causes an audible and visual alert to be generated to inform the operator of the problem. The visual alert is in the form of an alert provided on the LCD display device 156. In some embodiments, in addition or instead a lamp such as a light emitting diode (LED) device may be illuminated, optionally in a pulsed (flashing) manner, to provide the visual alert.

In the case that the fuel detected by the sensor 152 matches that corresponding to the tag 60, the controller 155 causes the valve device 120 to open. When the operator has finished loading fuel into the storage tank 30, the operator disconnects the hose 7 and unclamps the elbow apparatus 100 from the fluid inlet 30IN. Unclamping of the elbow apparatus 100 causes the controller 155 to close the valve device 120 and power down ("switch off") in order to conserve battery power. Upon subsequent connection to a fuel tank inlet 30IN by clamping the apparatus 100 to the inlet 30IN by means of the handle 177, the control portion 150 is again switched 'on' and controller 155 is configured to require reading of an RFID tag 60 before it can commence sensing of fluid in the conduit 110 and possible re-opening of the valve device 120. This is in order to ensure that an operator informs the fuel filling apparatus 110 of the type of fuel that is permitted to be unloaded into the storage tank 30 to which the apparatus 110 has now been connected, before any delivery takes place.

It is to be understood that in the present embodiment the controller 155 is also configured to communicate with the ATG control module 195, typically located in a sales kiosk 11 associated with the filling station 1. The controller 155 of the apparatus 100 communicates with the ATG control module 195 via the radio communications module 157B, informing the ATG control module 195 of the identity of the tank 30 to which the apparatus 100 is attached.

It is to be understood that the ATG control module 195 is configured to receive a signal from a fill level sensor 195S (FIG. 2) indicative of the level of liquid in each storage tank 30 of the filling station 1. When contacted by the controller 155 of the fuel filling apparatus 100, the ATG control module 195 responds by transmitting a signal indicative of the instantaneous fill level of the tank 30 to which the apparatus 100 is connected. The elbow apparatus 100 is configured to repeatedly interrogate the ATG module 195 to determine the fill level in the tank 30. In the present embodiment the apparatus 100 interrogates the ATG module 195 at intervals of around 10*s* although other values may be useful in some embodiments.

The controller 155 is configured to provide an audible and visual alert to the operator in the event that the fill level of the tank to which it is connected exceeds a predetermined alert level value, in the present embodiment a fill level of 80 percent although other values may be useful. In the event that the fill level subsequently reaches a predetermined shut-off level, in the present embodiment a fill level of 95 percent (other values may be useful in some embodiments), the controller 155 is configured automatically to cause the valve device 120 to close. Thus, it is to be understood that this embodiment of the apparatus 100 provides portable electronic overfill prevention functionality as well as misfuel prevention functionality. The apparatus 100 may thus be referred to as overfill prevention apparatus or misfuel prevention apparatus. It is to be understood that some embodiments do not have functionality for communicating with an ATG module and an operator may determine the current tank fill level by other means.

It is to be understood that the ATG control module 195 may provide an indication that the tank is at a fill level of 100 percent, where such a fill level corresponds to a value a predetermined amount below a maximum permissible fill level for that tank, for example of value of around 95 percent of the maximum allowable fill level in order to allow for thermal expansion of liquid stored in the tank and provide a safe margin permitting draining of fuel trapped within the fuel hose 7 into the tank 30 in the event the valve device 120 is closed automatically by the controller 155. It is to be understood that, in such a situation, an operator of the tanker 5 would close a valve allowing fuel to flow through the hose 7. The valve device 120 can then be opened as described below to allow fuel trapped within the hose 7 to drain into the tank 30 before the hose 7 is disconnected from the apparatus 100 and the apparatus 100 disconnected from the inlet 30IN of the tank 30.

In the present embodiment the apparatus 100 is configured to enable the operator to manually override the controller 155 when the valve device 120 is in the closed condition, forcing the valve device 120 to open, by means of an override RFID tag 62 which can be read by the reader module 157A. Upon detection of the presence of the override RFID tag 62 the controller 155 forces the valve device 120 to assume the open condition until the apparatus is subsequently disconnected from the tank inlet 30IN, at which time the controller 120 automatically causes the valve device 120 to close. As described above, this permits an operator to drain fuel remaining in the hose 7 and apparatus 100, following automatic closure of the valve device 120 by the controller 155.

In some alternative embodiments, instead of being overridden by an RFID tag 62, the controller 155 may be forced to close or open the valve device 120 by means of a radio frequency (RF) remote control device 63 that communicates with the controller 155 via the radio communications module 157B or a separate, dedicated radio communications module. Other means for overriding the valve device 120 may be provided in some embodiments such as a control switch configured to cause the controller 155 to open the valve device 155 or a manual lever configured to physically close the valve device 120.

It is to be understood that in the event of a manual override of the valve device 120, whether by means of an override RFID tag 62 or remote control device 63, or other suitable means, the controller 155 logs in the memory of the controller 155 the fact that an override took place, and the time of the override, for later retrieval, for example in the event that a misfuel event takes place and the cause of the misfuel event requires investigation.

As noted above, in the present embodiment the apparatus also has a charging module 140 having an electrical generator that includes an electrical machine 143 configured to generate electrical power for recharging a battery 144 that powers the apparatus 100. The electric machine 143 may for example be a dynamo or any other suitable generator of electricity. The charging module 140 includes an "impeller" or "turbine" element 142 arranged to drive the electric machine 143. The turbine element 142 is arranged to be disposed, in use, in a flow stream of liquid through the conduit 110 such that flow of liquid through the conduit 110 causes turning of the turbine element 142. In the embodiment shown the turbine element 142 is arranged such that it's axis of rotation is substantially normal to the flow stream. In the embodiment shown the turbine element 142 is arranged such that flow of liquid occurs over substantially the whole of an exposed face of the element 142, the blades of the element being angled such that, in use, liquid flowing over the half of the face of the element 142 that is moving in an (upward) direction against the flow of liquid subjects the blades to a lower rotational force than the blades moving in a (downward) direction with the flow of liquid. In the present embodiment the turbine element 142 is arranged to rotate in a clockwise direction in a flowstream of liquid downwardly, as viewed from within the conduit 110, i.e. from the viewpoint of FIG. 4. Other designs for turbine element 142 may be useful in some embodiments.

It is to be understood that the charging module 140 may generate sufficient power to maintain the battery 144 with sufficient charge to permit operation of the controller 155 and actuation of the valve device 120 as required, in a given tank filling operation.

In some embodiments, at least half of the turbine element 142 may be shielded from liquid flow by means of a cover or cowl so as to reduce torque on the element 142 opposite the direction of intended rotation.

In some embodiments the turbine element may be arranged with its axis of rotation substantially parallel to or near parallel to the direction of flow of liquid through the conduit 110.

Figure 7:
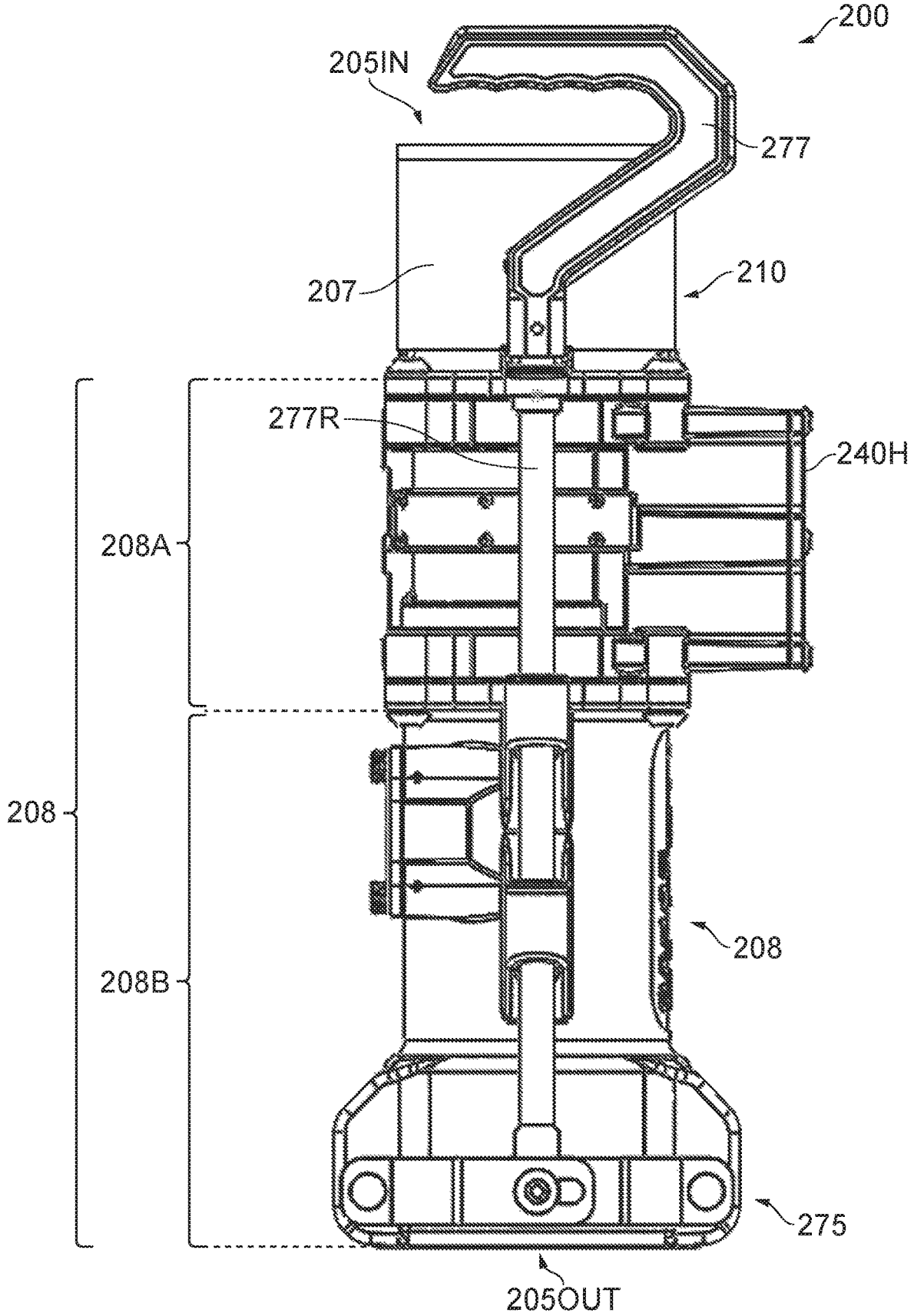
FIG. 7 is a side view of apparatus according to a further embodiment of the present invention.

FIG. 7 shows a fuel filling apparatus 200 according to a further embodiment of the present invention. Like features of the apparatus 200 of the embodiment of FIG. 7 to those of the apparatus 100 of the embodiment of FIGS. 1 to 6 are shown with like reference numerals incremented by 100. The apparatus 200 has a similar fluid inspection sensor 252 (FIG. 10) to the fluid inspection sensor 152 of the embodiment of FIG. 1 and a similar control portion 250 to the control portion 150 of the embodiment of FIG. 1.

The apparatus 200 of FIG. 7 has a substantially straight inlet portion 207, above the first portion 208A of the upright portion 208 instead of the angled inlet portion 107 of the embodiment of FIGS. 1 to 6.

Figure 8:
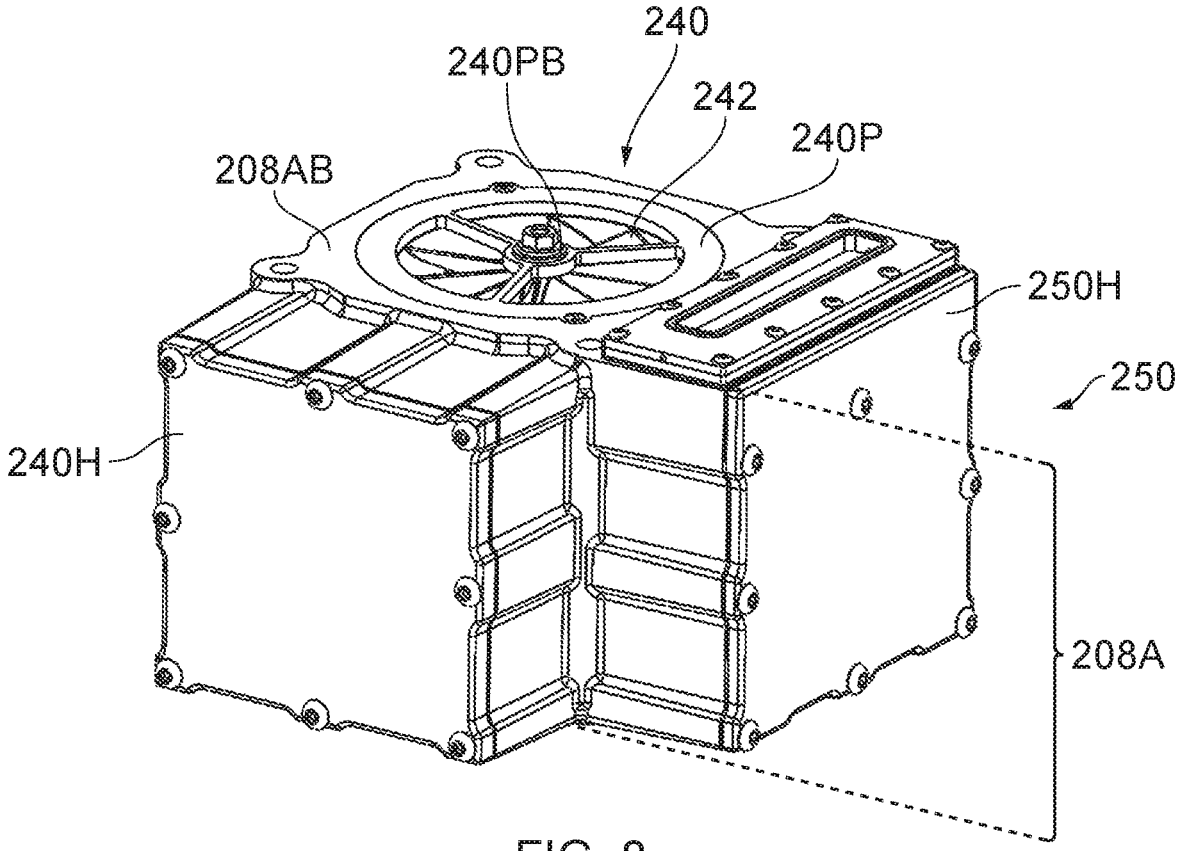
FIG. 8 is a perspective view from above of a first (upper) portion of the apparatus of FIG. 7.
Figure 9:
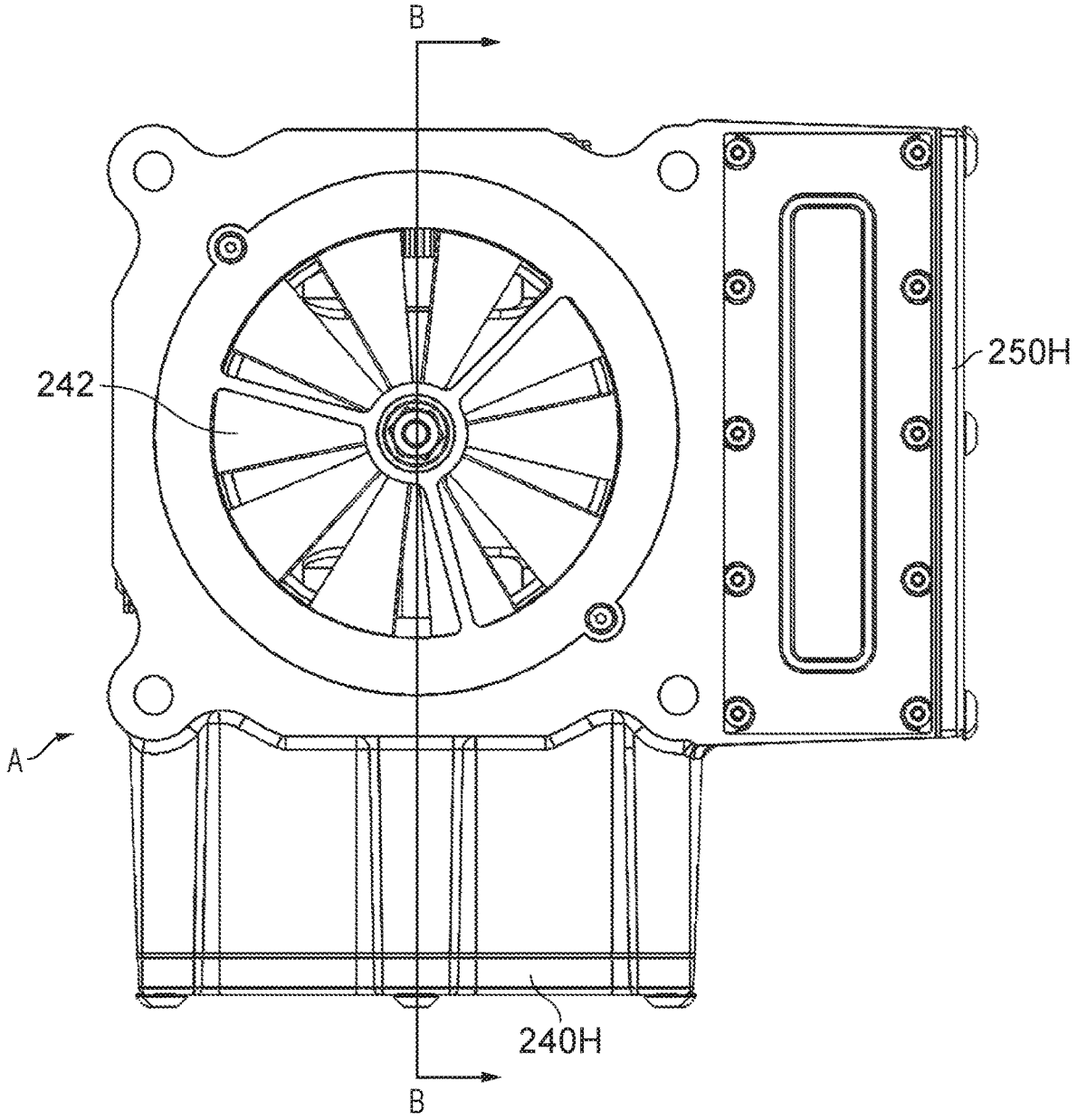
FIG. 9 is a plan view of the first portion of the apparatus shown in FIG. 8.
Figure 10:
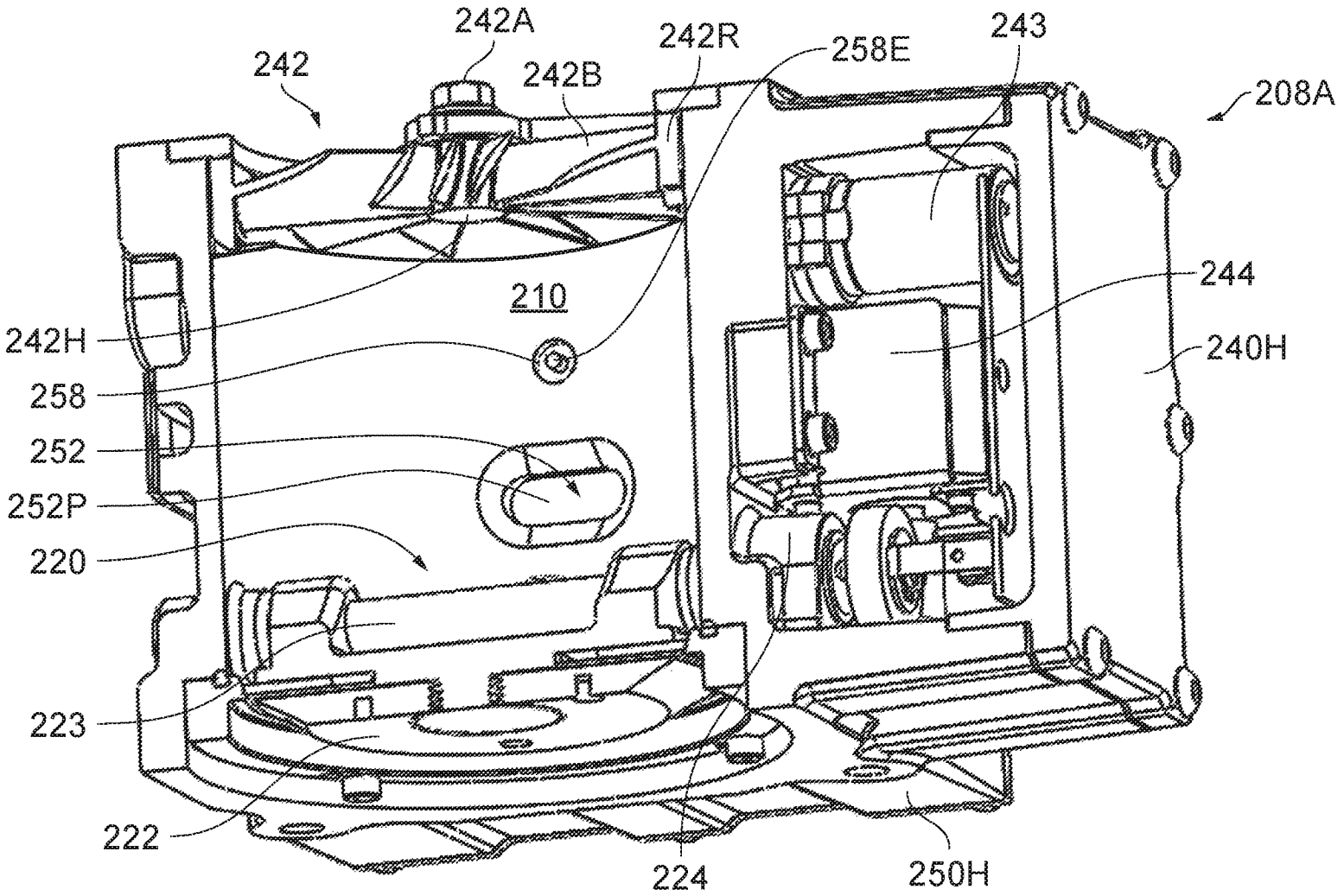
FIG. 10 is a perspective view of a portion of the first portion of the apparatus shown in FIG. 8 and FIG. 9 with the portion of the apparatus to the left of line BB in FIG. 9 removed.

As in the embodiment of FIGS. 1 to 6, the first portion 208A includes the charging module 240. FIG. 8 is a perspective view from above of the first portion 208A of the apparatus 200 separately from the remainder of the apparatus 200. FIG. 9 is a plan view of the first portion 208A. FIG. 10 shows a portion of the first portion 208A with the portion to the left of line BB of FIG. 9 removed, and as viewed generally in the direction of arrow A of FIG. 9 from below.

As may be seen from FIGS. 8 to 10, the charging module 240 of the embodiment of FIG. 7 differs from that of the embodiment of FIGS. 1 to 6 in that the impeller 242 is arranged with its axis of rotation substantially parallel to a longitudinal axis of the conduit 210 rather than substantially normal to it. The charging module 240 has an impeller 242 comprising six blades 242B spanning a gap between a central hub 242H of the impeller 242 (FIG. 10) and a radially outer circumferential ring element 242R of the impeller 242. The hub 242H and ring element 242R provide mechanical support for the blades 242B. It is to be understood that forces on the blades 242B can be relatively high during filling operations due to the flow rate of fuel from a tanker 5 and the additional support provided by the ring element 242R enhances the mechanical strength of the impeller 242.

The impeller 242 is itself supported from above by a support plate 240P that is rigidly attached to a body 208AB of the first portion 208A of the apparatus 200. The support plate 240P carries a bearing 240PB to which the hub 242H of the impeller 242 is attached, the bearing 240PB allowing free rotation of the impeller 242 with respect to the support plate 240P. The hub 242H is provided substantially coaxial of the conduit 210, which is of substantially circular cross-section. The ring element 242R of the impeller 242 is of a diameter slightly smaller than the internal diameter of the conduit 210 so as to allow free rotation without contact between the impeller 242 and conduit 210, whilst also permitting only a relatively small amount of liquid passing through the conduit 210 to pass around the outside of the impeller 242 without passing through the impeller 242. Thus, substantially all of the liquid flowing through the conduit 210 passes through the impeller 242, driving rotation of the impeller 242.

In some embodiments, the internal diameter of the conduit 210 is in the range from 100 mm to 200 mm, the impeller having an outer diameter approximately 4-6 mm smaller than the internal diameter of the conduit 210 such that a gap is present between the impeller and inner wall of the conduit 210 in the range from 2-3 mm. Other diameters of conduit 242 and impeller 210 may be useful in some embodiments. Other sizes of gap between impeller 242 and conduit 210 may also be useful. In some alternative embodiments, the impeller 242 may have a larger diameter than the conduit 210 and be placed above or project into a recessed portion of the conduit 210.

The impeller 242 is arranged to drive a drive shaft 243S (FIG. 14) of an electric machine 243 arranged to generate electrical power in response to rotation of the impeller 242. The electrical power charges a battery 244. The battery 244 provides power to drive the control portion 250 provided within housing 250H, including opening and closing the valve device 220 in a similar manner to the embodiment of FIG. 1.

Also visible in FIG. 10 is the fluid inspection sensor 252 and a liquid presence sensor 258 in the form of a capacitive sensor 258. The liquid presence sensor 258 has an electrode 258E that is provided in a recess formed in an inner wall of the conduit 210 of the upper portion 208A, the electrode 258E being insulated from the wall of the conduit 210. The electrode protrudes radially inwardly from within the wall of the conduit 210 into the recessed area in the inner wall of the conduit 210 as shown in FIG. 10 such that when the conduit 210 is filled with liquid, the liquid fills a space between the electrode 258E and the portion of the inner wall 210 defining the recess. The presence of liquid in the conduit 210 is determined by monitoring the capacitance of the electrode 258E, since a change in capacitance occurs in the presence of a liquid such as diesel oil or petrol compared with air or water vapour, in the gap between the electrode 258E and inner wall of the conduit 210. The control portion 250 of the apparatus 200 controls the liquid presence sensor 258. In some embodiments, the liquid presence sensor 258 is operated as a conductivity sensor, in which current flow between the electrode 258E and earth (via conduit 210) is measured, the current flow for a given electrical potential applied to the electrode 258E being dependent on conductivity of the medium. It is to be understood that, based on measurements of conductivity, the control portion 250 is able to determine whether there is no liquid present in the conduit 210 (substantially no current flow between the electrode 258E and the body of the conduit 210), or whether the conduit is filled with water, or fuel, water typically having a higher conductivity that petrol or diesel fuels. Thus the control means 150 can distinguish between water and fuel by means of conductivity measurements.

Figure 11:
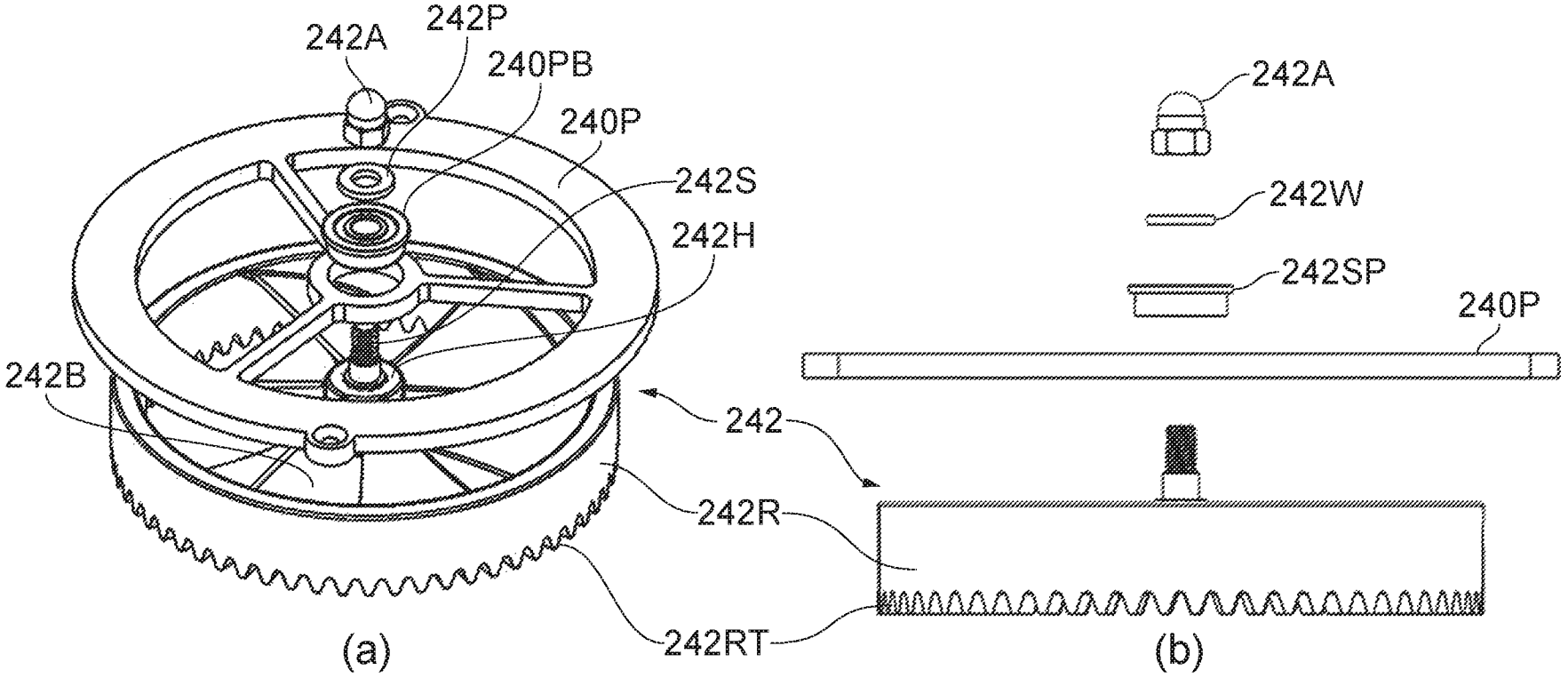
FIG. 11 is an exploded view of a portion of the embodiment of FIGS. 7 to 10 for supporting an impeller in (a) perspective and (b) side view.

FIG. 11 is an exploded view of a portion of the upper portion 208A of the apparatus 200 in (a) perspective and (b) side views. FIG. 11 shows support plate 240P, impeller 242 and its threaded axle 242S, bearing 240PB, washer 242W and securing nut 242A. Teeth 242RT formed in the lower edge of the rim 242R of the impeller 242 can be seen. The teeth 242RT are arranged to engage a gear or drive wheel 242DW (FIG. 13) that drives electric machine 243 as described in further detail below.

Figure 12:
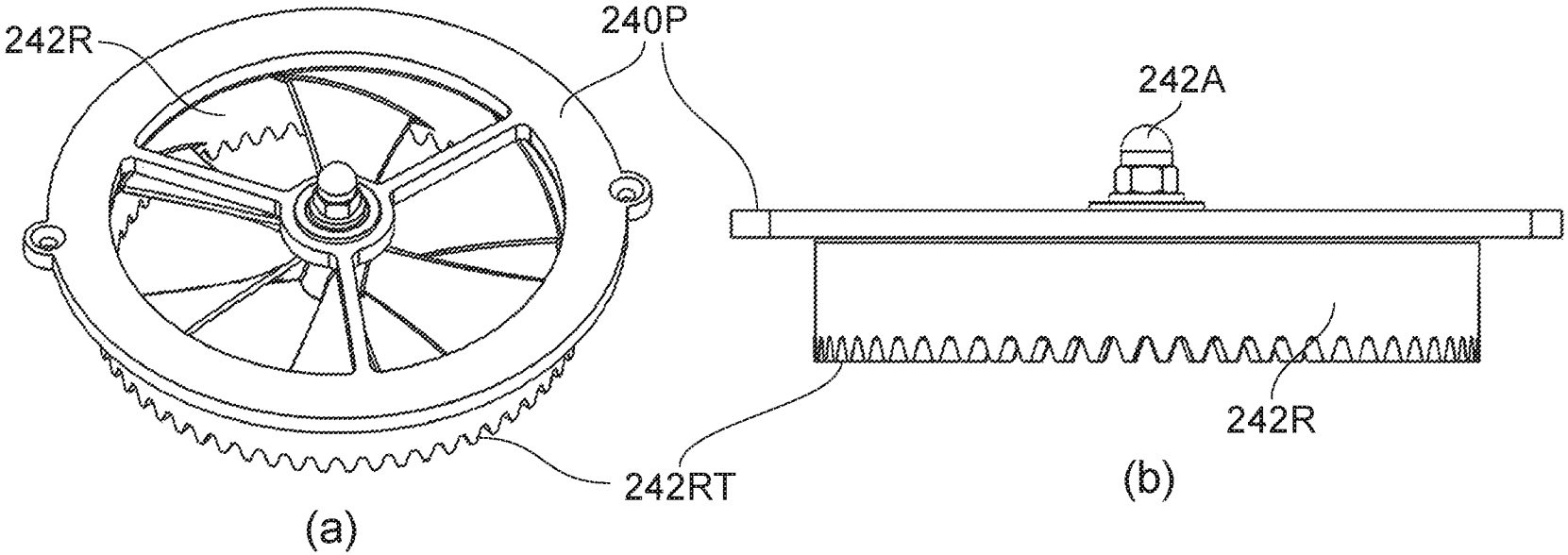
FIG. 12 is an assembled view of the portion of the apparatus shown in FIG. 11 in (a) perspective and (b) side view.

FIG. 12 is an assembled view of the impeller in (a) perspective and (b) side views, corresponding to the views of FIG. 11.

Figure 13:
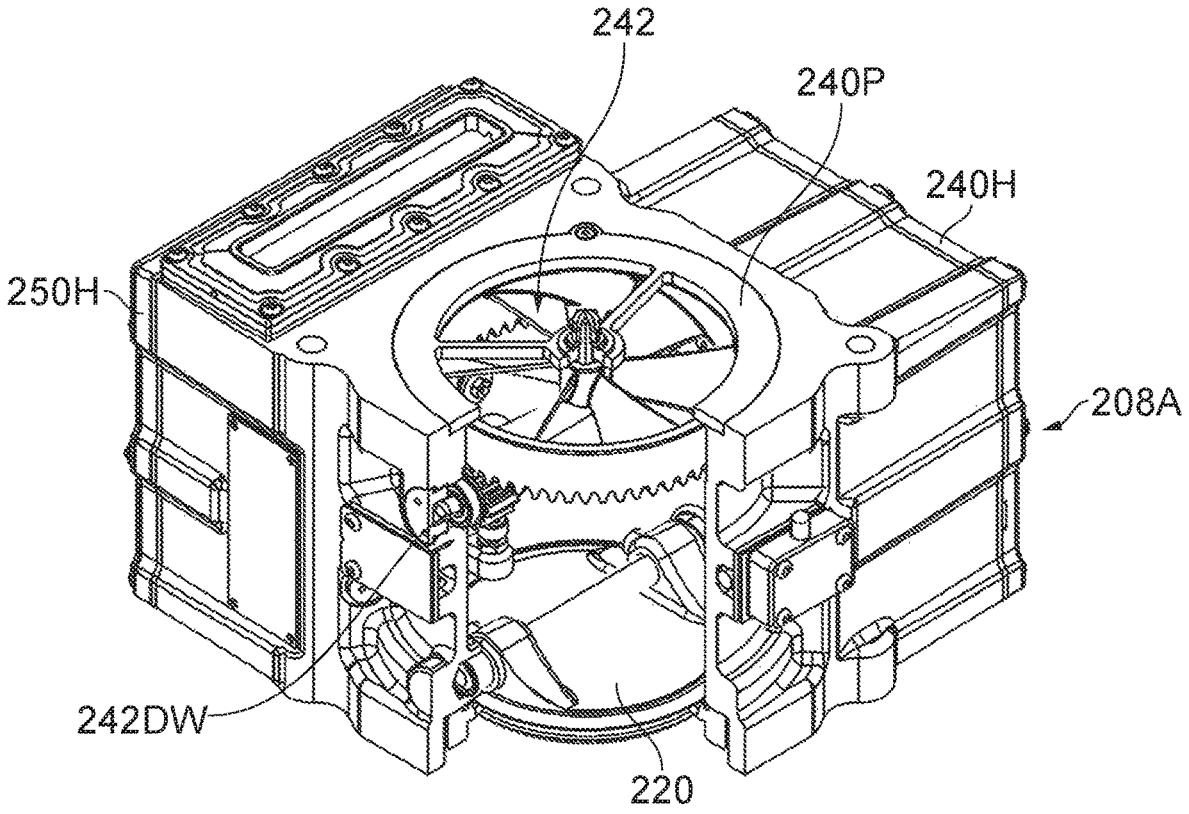
FIG. 13 is a perspective view from above of the first (upper) portion of the apparatus of FIG. 7 with a portion cutaway to internal detail.
Figure 14:
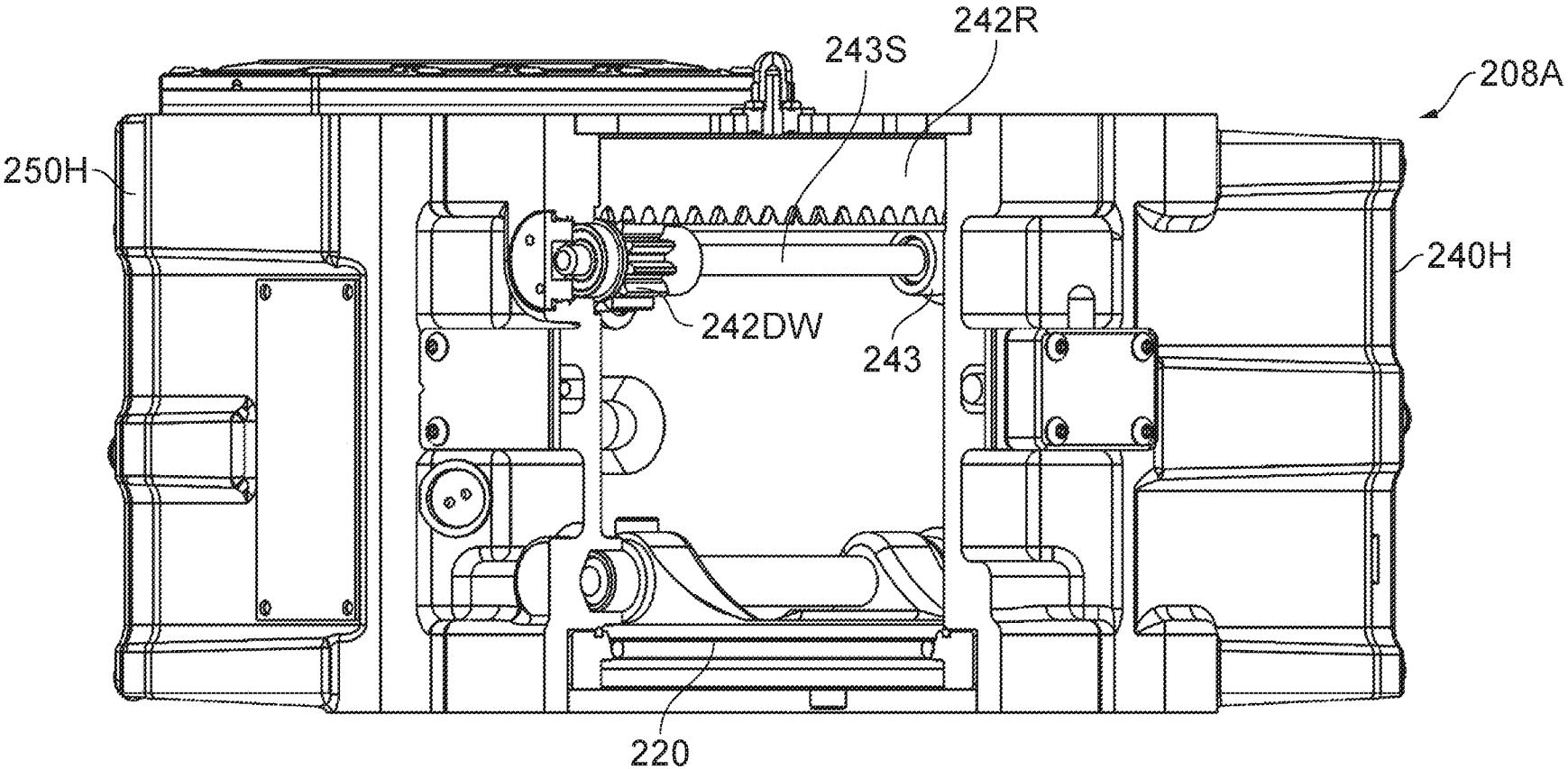
FIG. 14 is a side view corresponding to FIG. 13.

FIG. 13 is a perspective view of the upper portion 208A of the apparatus 200 from above with a portion of a side of the upper portion 208A removed to show internal details including the valve device 220. FIG. 14 is a side view corresponding to the view of FIG. 13. As may be seen in FIG. 13 and FIG. 14, the teeth 242RT formed in the lower edge of the rim 242R engage a gear wheel that will be referred to as a drive wheel 242DW. The drive wheel 242DW drives a drive shaft 243S (FIG. 14) that drives electric machine 243 of the charging module 240 provided within housing 240H.

Figure 15:
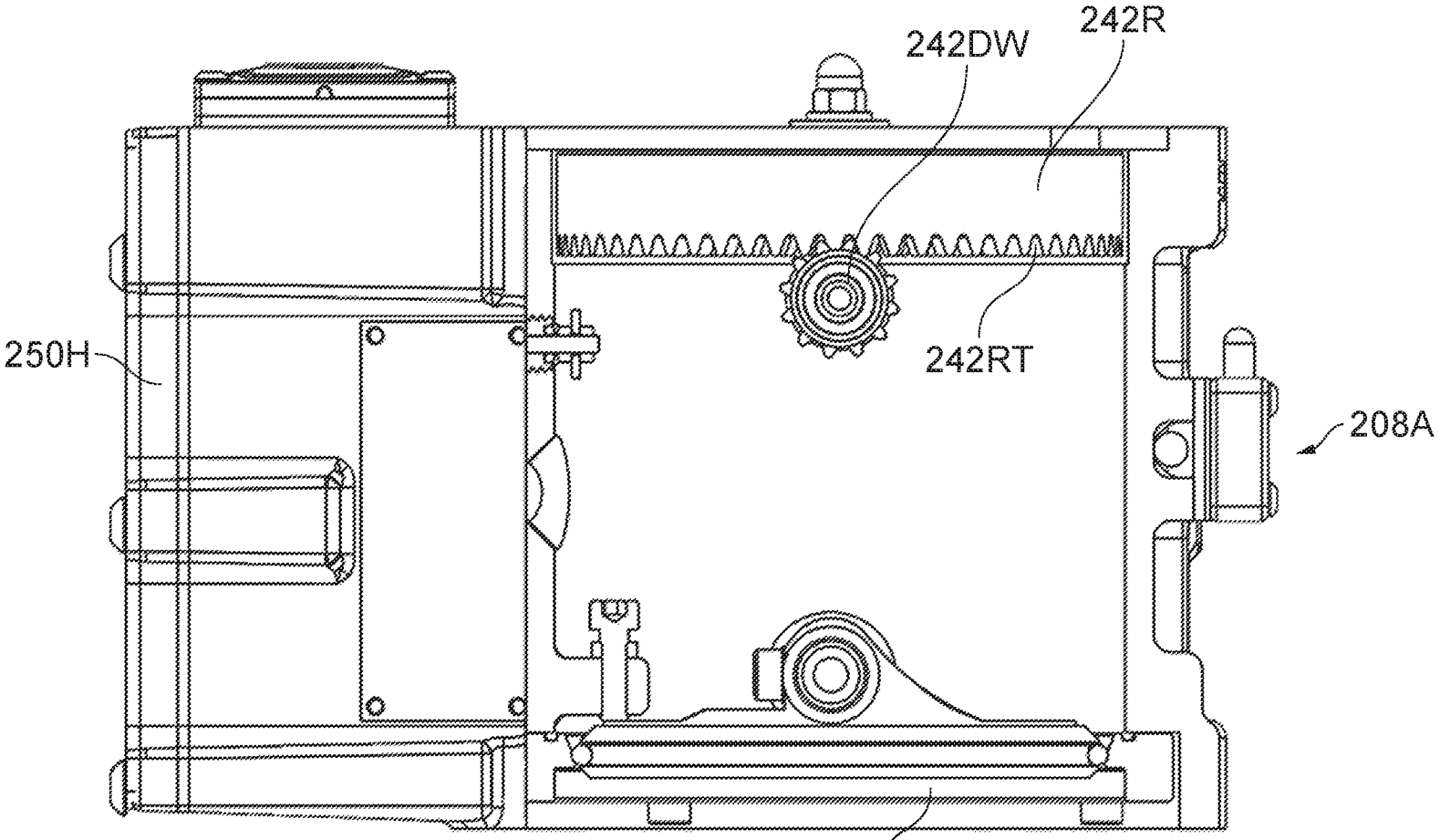
FIG. 15 is a side view corresponding to FIG. 13 with the first (upper) portion of the apparatus rotated anticlockwise with respect to a view from above.

FIG. 15 is a side view corresponding to that of FIG. 14 as viewed parallel to a longitudinal axis of the drive shaft 243S.

Figure 16:
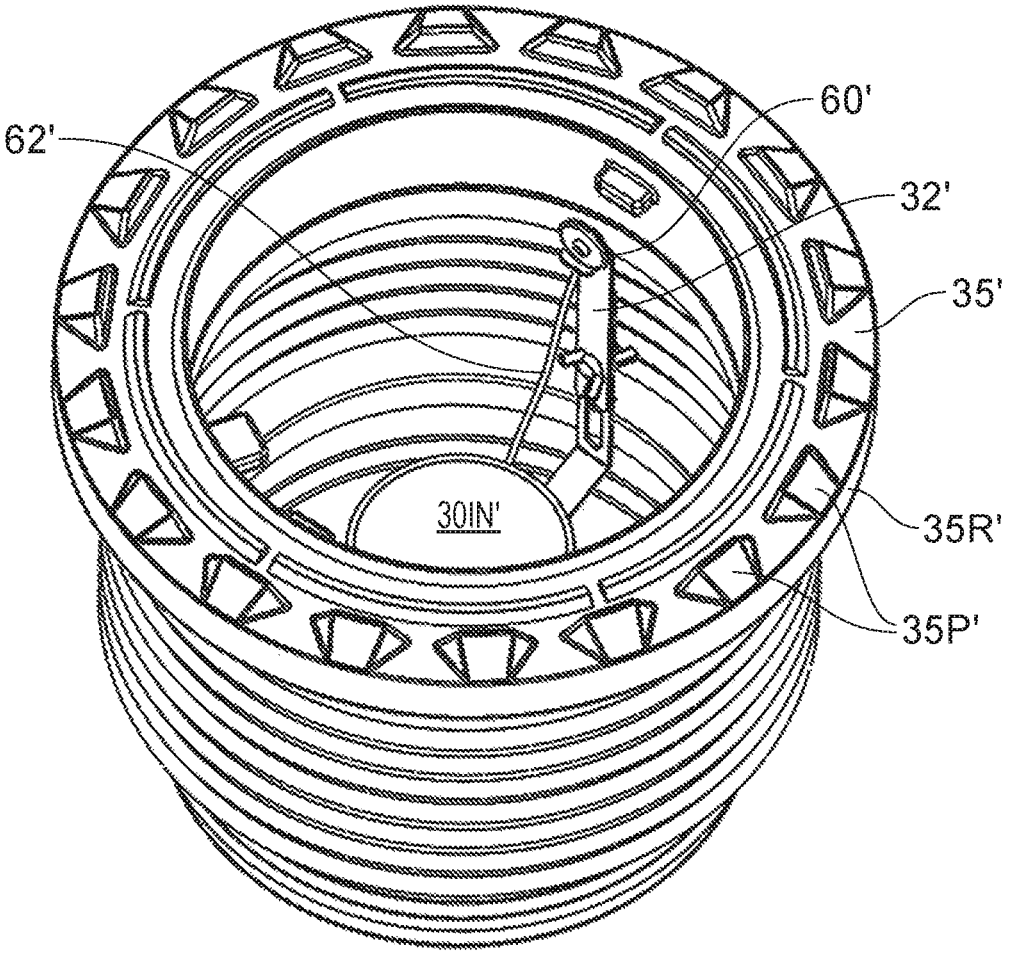
FIG. 16 is a perspective view of a spill bucket arranged to be provided in a hole formed in ground.

It is to be understood that, in some arrangements, the inlet 30IN to an underground fuel storage tank 30 may be located below ground level. Such an arrangement reduces the amount of forecourt real estate that is otherwise unavailable for vehicle movement, as well as reducing the risk of damage to the inlet 30IN due to vehicle movement, for example when a vehicle is reversing. FIG. 16 is a perspective view of a spill bucket 35' that may be installed at locations having a fuel inlet 30IN' below ground level. The spill bucket 35' is arranged to be placed in a hole formed in ground at the location of the inlet 30IN and has an upper rim 35R' that is arranged to be provided substantially at ground level, for example supported by ground defining an edge of the hole into which the spill bucket 35' is inserted. An upper surface of the rim 35R' has raised protrusions 35P' around the rim 35R' that constrain lateral displacement of a substantially flat, circular cover (not shown) that may be placed on the rim concentric of the protrusions 35P' to permit vehicle or personnel movement over the bucket 35'.

A bracket 32' is provided for mounting to the inlet 30IN', the bracket 32' having an aperture therein through which a tether 62' in the form of a flexible cord in the embodiment shown is threaded, the tether 62' being attached to RFID tag 60' at one end. The aperture for the tether 62' is obscured in FIG. 16 by the RFID tag 60'. The tether 62' is attached, at an opposite end thereof, to the bracket 32' to prevent removal therefrom. In some embodiments the tether 62' may have a stop at or near the end opposite the end to which the RFID tag 60' is attached, in the form of a knotted portion or an object of sufficient size to prevent detachment of the tether 62' from the bracket 32'. The tether 62' is arranged to allow the tag 60' to be lifted a sufficient distance above the bracket 32' to permit the tag 60' to be presented to the reader module 157A of the apparatus 100 (or reader module 257A of the apparatus 200 of the embodiment of FIG. 7) coupled to that inlet 30IN' and to allow the reader module 157A to read the tag 60'. However, the tether 62' is also arranged not to permit the tag 60' to be moved a sufficiently large distance to allow the tag 60' to be presented to the reader module 157A of apparatus 100 that may be coupled to the inlet 30' of another liquid storage tank 30 that may be present nearby. It is to be understood that the other liquid storage tank 30 may contain fuel of a different type to that of the tank 30 with which the RFID tag 60' is associated, and presentation of that tag 60' to apparatus 100 attached to the other tank 30 may result in a misfuelling event taking place.

Figure 17:
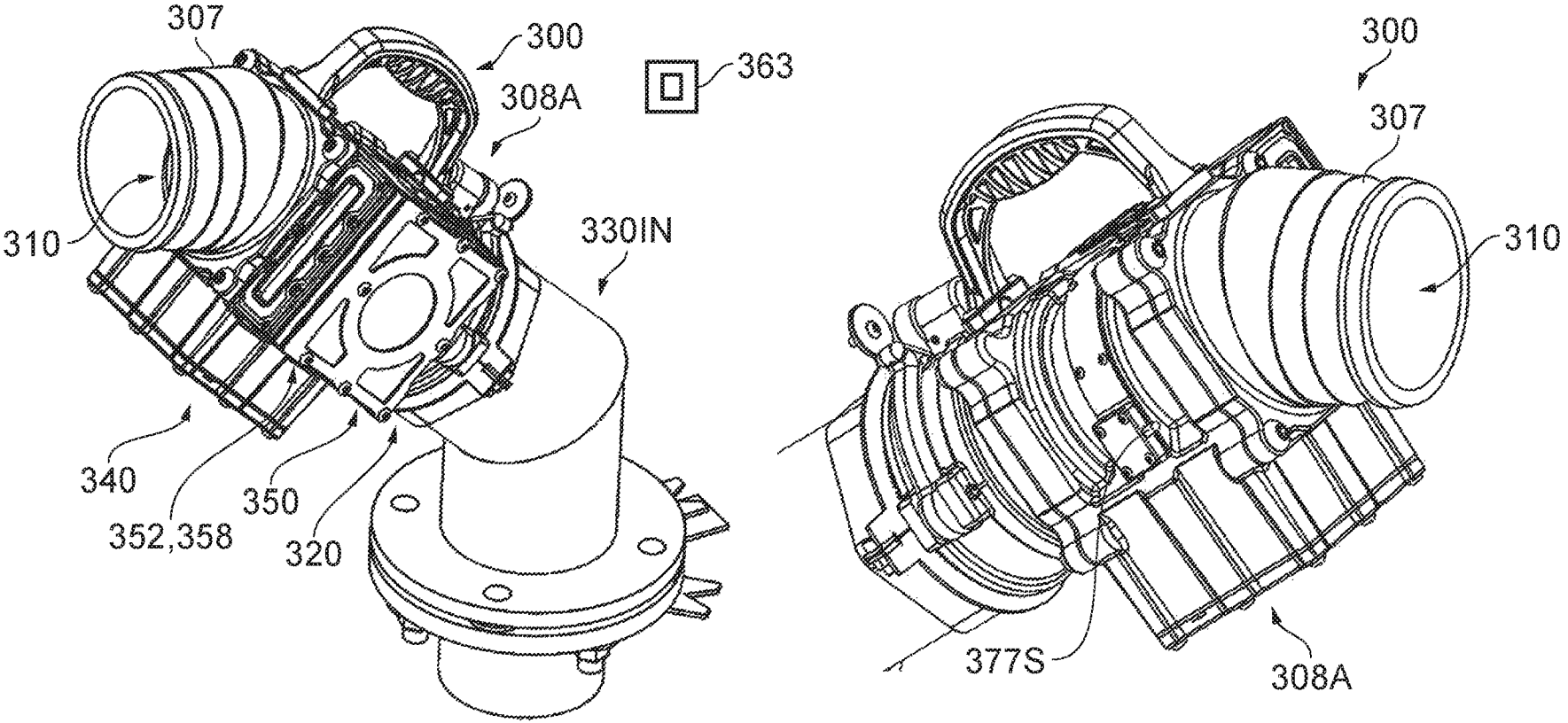
FIG. 17 shows perspective views of apparatus according to a further embodiment of the invention coupled to a liquid inlet of a fuel storage tank from (a) one side and (b) an opposite side.

FIG. 17 shows apparatus 300 according to a further embodiment of the present invention attached to a fuel tank inlet 330IN. FIG. 17(*a*) shows a right hand side of the apparatus 300 as viewed from a front of the apparatus 300 whilst FIG. 17(*b*) shows a left hand side. Like features of the embodiment of FIG. 17 to those of the embodiment of FIGS. 7 to 15 are shown with like reference signs incremented by 100. It is to be understood that the portion 308A of the apparatus 300 between the angle inlet portion 307 and clamping elements 375 is similar to the first portion 208A of the embodiment of FIG. 7, the apparatus having a similar liquid detector 352, liquid presence sensor 358 and valve device 320 to the embodiment of FIG. 10. It is to be understood that the liquid detector 352, liquid presence sensor 358 and valve device 320 are hidden from view in the drawings shown, but their locations within the apparatus 300 are indicated generally in FIG. 17 for clarity.

It is to be understood that the embodiment of FIG. 17 is of reduced length compared with that of the embodiments of FIGS. 1 to 15 and is particularly suited for coupling to a tank inlet 330IN that is located above ground, where the inlet 330IN is readily accessible to the hand for attachment of the apparatus 300 to the inlet 330IN, rather than one that is located below ground such as that shown in FIG. 16.

The embodiment of FIG. 17 is provided with a similar charging module 340 and control portion 350 to the embodiment of FIGS. 7 to 15.

Figure 18:
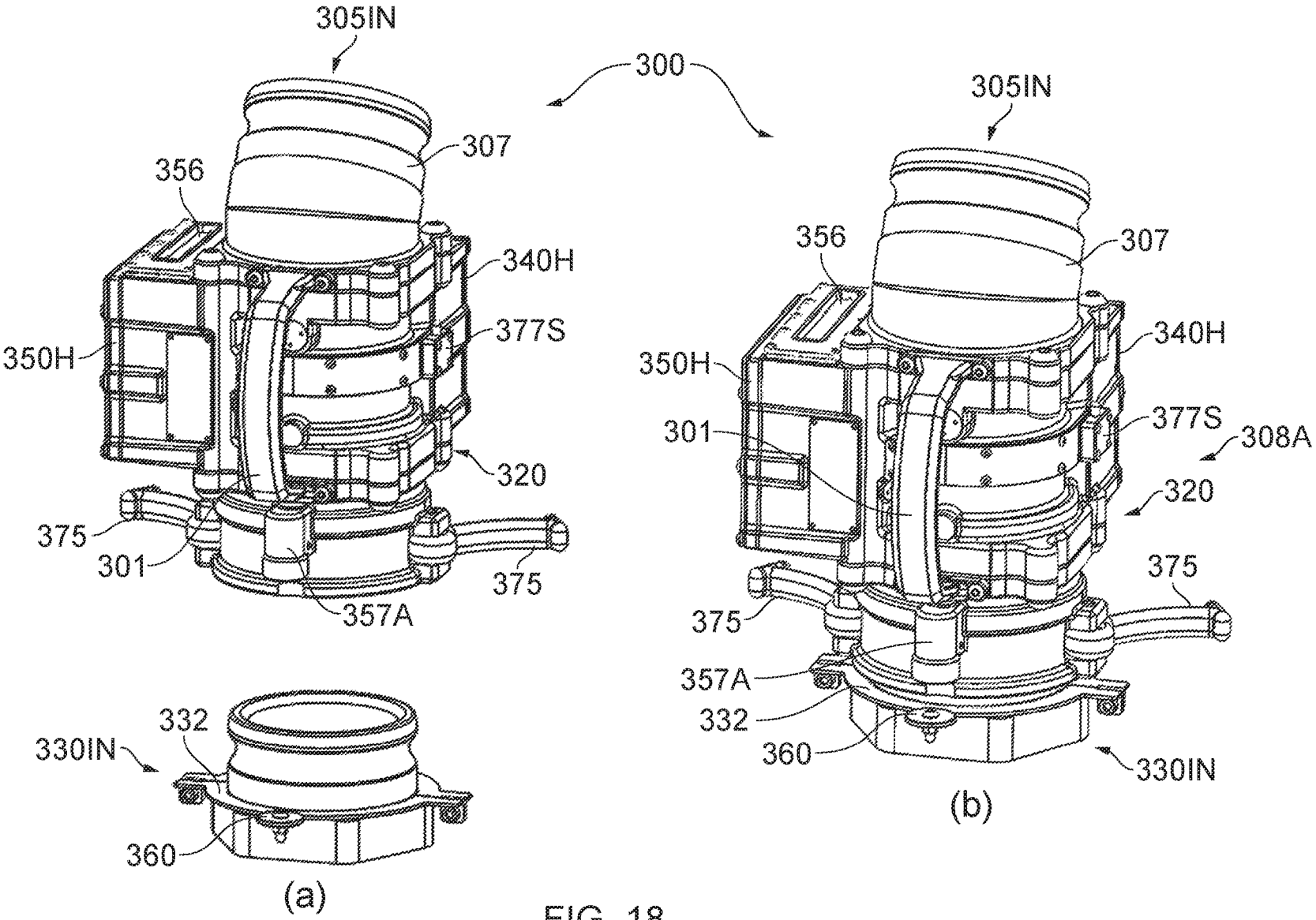
FIG. 18 shows rear perspective views of the apparatus of FIG. 17 (a) before and (b) after placing the apparatus on a liquid inlet of a fuel storage tank, with clamp elements in an open, unlocked condition, and (c) after placing the clamp elements in a locked condition in which the apparatus is secured to the inlet.
Figure 18:
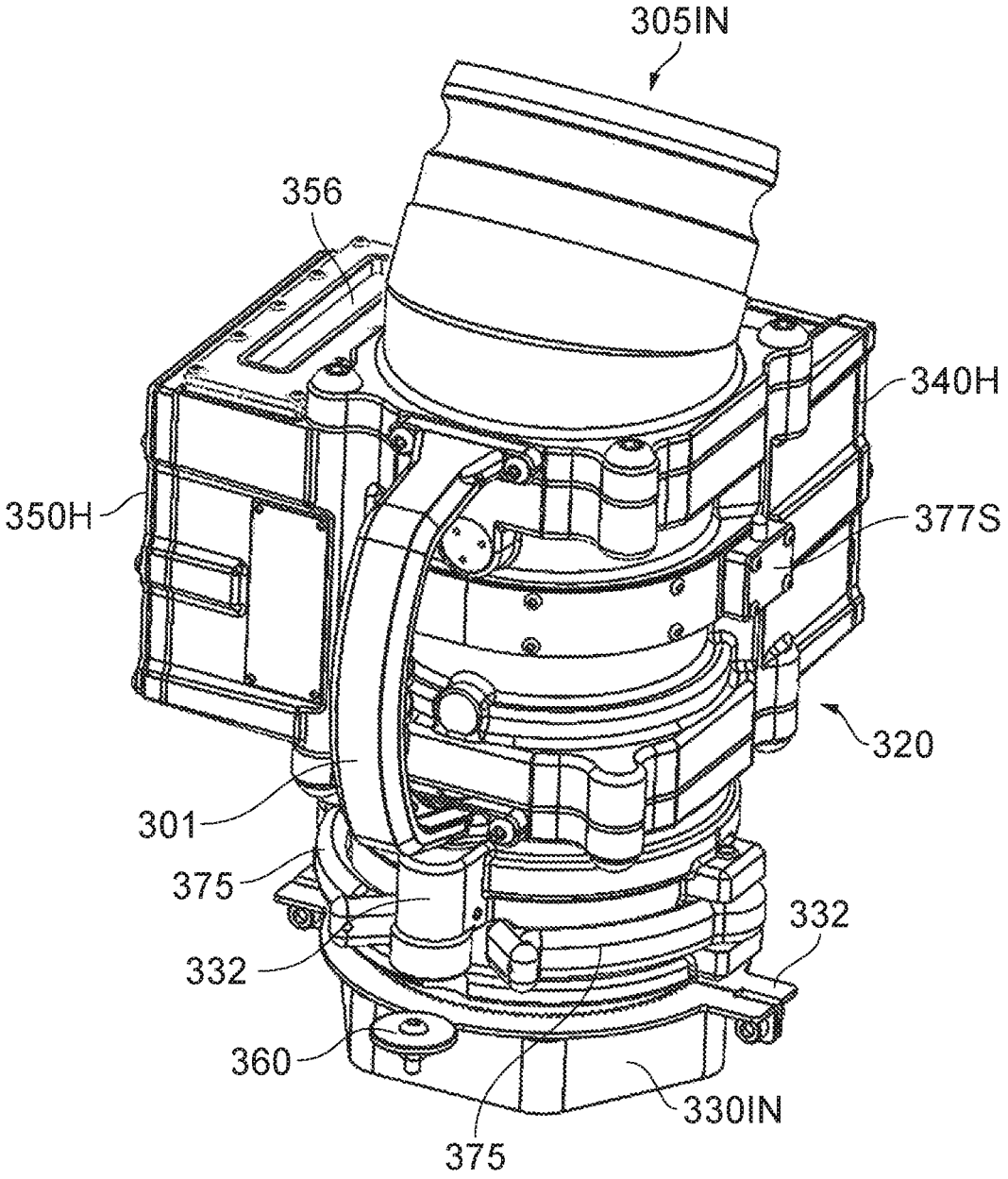

FIG. 18 shows the apparatus 300 (*a*) before it is offered to the inlet 330IN, (b) after the apparatus 300 has been placed on the inlet 330IN but before it has been secured thereto, and (c) after the apparatus 300 has been secured to the inlet 330IN. In contrast to the embodiment of FIG. 7, the embodiment of FIG. 17 is arranged to be attached to a fuel inlet 330IN by separate actuation, by means of the hand(s) of an operator directly, of each of a pair of clamp elements 375 of the apparatus 300 in a known manner. The clamp elements 375 are arranged to be swung from the radially outward orientation of FIG. 18(*b*) to the radially inner, clamped, orientation of FIG. 18(*c*) in order to secure the apparatus 300 to the inlet 330IN.

Figure 19:
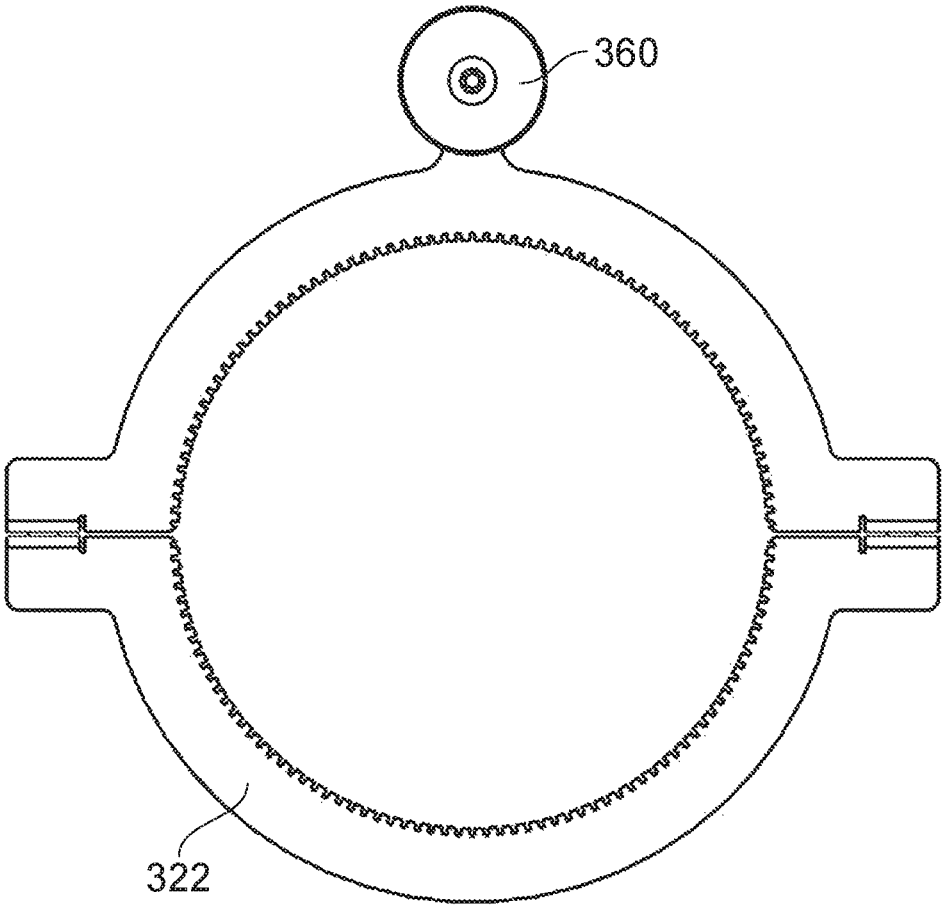
FIG. 19 shows a bracket with RFID tag for attachment to an inlet of fuel storage tank.
Figure 20:
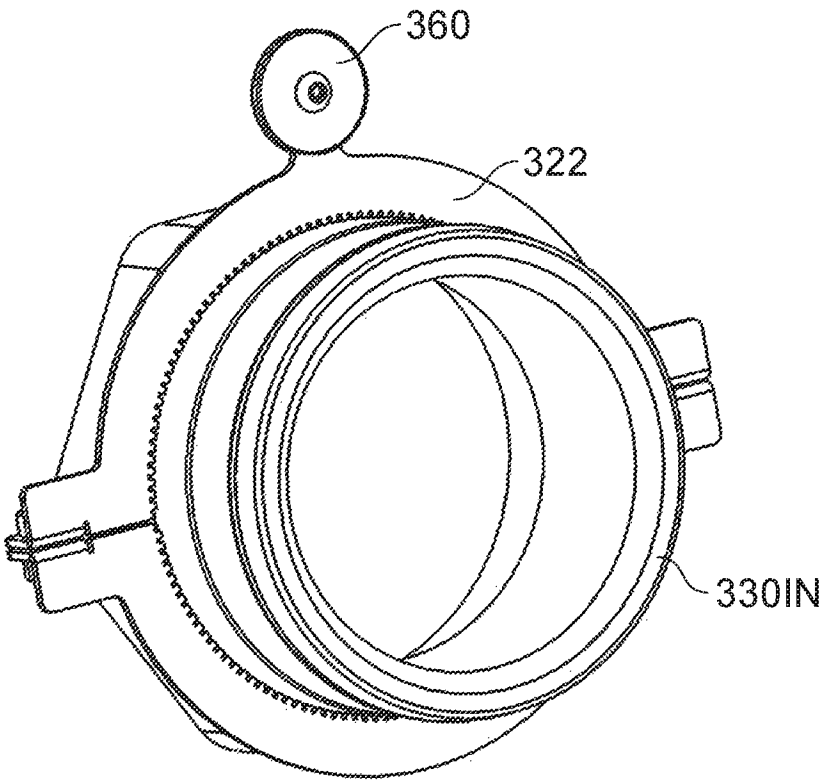
FIG. 20 shows the bracket of FIG. 19 (a) prior to coupling to a fuel storage tank inlet and (b) after coupling to the inlet.
Figure 20:
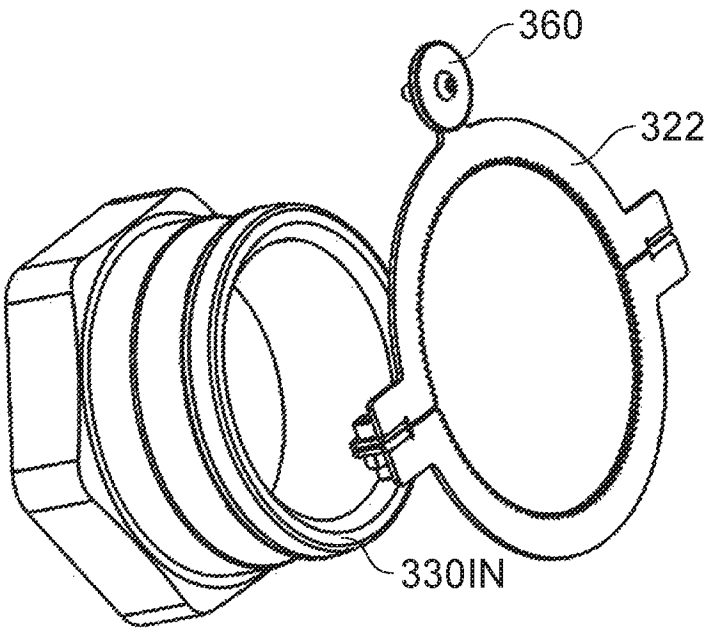

The apparatus 300 has an RFID reader module 357A located external to the control portion 350 but in electrical communication therewith by means of a wired connection. The RFID reader module 357A is positioned at a lower edge of the apparatus 300 such that, when the apparatus 300 is coupled to a tank inlet 330IN, it is directly adjacent the fluid tank inlet 330IN to which the apparatus 300 is coupled. The tank inlet 330IN has a bracket or collar 332 coupled thereto. The collar 332 has an RFID tag 360 attached thereto. The collar is positioned such that when the apparatus 300 is coupled to the inlet 330IN, the RFID tag 360 is in sufficient proximity to the apparatus 300 that, if the apparatus 300 is coupled to the inlet 330IN with the reader module 357A substantially directly facing the RFID tag 360, the reader module 357A is able to read the tag 360. It is to be understood that in some embodiments the reader module 357A may be configured to read a tag 360 of the apparatus 300 at substantially any rotational position, or within a relatively broad range of rotational positions. In some embodiments, the tank inlet 330IN and apparatus 300 may have complementary formations provided therein or thereon such that the apparatus 300 may only be attached to the inlet 330IN at a particular rotational orientation. The collar 332 can therefore be positioned on the inlet 330IN at a rotational position corresponding to alignment of the RFID tag 360 with the reader module 357A when the apparatus 300 is attached to the inlet 330IN. FIG. 19 is a plan view of the bracket 322 shown in FIG. 18 whilst FIG. 20 shows the bracket 322 (a) prior to attachment to the inlet 330IN and (b) following attachment to the inlet 330IN.

In the embodiment of FIG. 18, the apparatus 300 is activated by means of a button switch 377S having a button that an operator may press in order to actuate the switch 377S. When the button switch 377S is pressed, the apparatus 300 assumes an "on" condition in which the control portion 350 receives electrical power, i.e. is 'powered up'. The control portion 350 causes the reader module 357A to read data stored in the RFID tag 360 (as described above with respect to the embodiments of FIGS. 1 to 15). Information in respect of the type of fuel indicated on the tag 60 is stored in memory of the control portion 350. It is to be understood that in the present embodiment the control portion 350 also stores information in respect of the identity of the tank 30 to which the apparatus 300 is connected (such as tank number at the location), and a code indicative of the location of the filling station (such as a filling station number or geographical location), obtained from the tag 360 by the reader module 357A. The apparatus 300 may now be considered to be 'latched' electronically, via the reader module 357A and tag 360, to the tank inlet 339IN.

The control portion 350 is configured to maintain the valve device 320 of the apparatus 300 in the closed condition until the reader module 357A has read the tag 360. It is to be understood that the reader module 357A may read additional information from the tag 360 in some embodiments.

Once the apparatus 300 has read the RFID tag 360, the control portion 350 provides an indication to an operator via liquid crystal display (LCD) display device 356 of the type of liquid (in the present embodiment, petrol (and optionally octane rating—such as indication that 'regular' or 'super' petrol is to be delivered), or diesel) that is permitted to be delivered to the tank 330. The operator may then commence delivery of fuel from the tanker 5 (FIG. 2) via a delivery hose 7 to the fuel filling apparatus 300.

Once the control portion 350 has read and stored fluid type data carried by the RFID tag 360, as described above, the control portion 350 monitors the output of fluid inspection sensor 352 of the apparatus 300, being substantially identical to the fluid inspection sensor 252 of the embodiment of FIG. 7. Once liquid is detected in the conduit 310, by means of liquid presence sensor 358, the control portion 350 again causes the reader module 357A to read data stored in the RFID tag 360 in respect of the type of fuel indicated on the tag 360. The control portion 350 also determines the liquid type in the conduit 310 (petrol or diesel) by reference to the fluid sensor 352. The control portion 350 checks whether the fresh information in respect of fuel type received from the reader module 357A corresponds to the type of fuel identified by the fluid inspection sensor 352. If the data read from the tag 360 in respect of the type of fuel stored in the storage tank 330 does correspond to the fuel identified by the fuel sensor 352, then the control portion 350 opens the valve 320 and fuel is permitted to be delivered to the tank inlet 330IN. Thus, the apparatus 300 ensures that it is still electronically latched to the same tank inlet 330IN as when the apparatus 300 was first switched on via switch 377S.

In some embodiments, once liquid is detected in the conduit 310, by means of liquid presence sensor 358, and the control portion 350 again causes the reader module 357A to read data stored in the RFID tag 360, the control portion 350 causes the reader module to read data stored in the tag 360 in respect of the type of fuel indicated on the tag 360, the identity of the tank 330 to which the apparatus 300 is connected, and a code indicative of the location of the filling station. The control portion 350 receives this data and compares the data read from the tag 360 in respect of the type of fuel stored in the storage tank 330 with the fuel identified by the fuel sensor 352. The control portion 350 also compares information in respect of the identity of the tank 330 to which the apparatus 300 is connected, and optionally the code indicative of the location of the filling station, with the data stored when the apparatus 300 was first switched on and the RFID tag 360 first read. The control portion 350 checks that the information freshly received corresponds to that already stored in memory of the control portion 350. If the information has changed, the control portion stores the new information in addition to the previously stored information, such that it is apparent to a person reading the data stored in the memory that the information changed prior to delivery of fuel to the fuel inlet 330IN. If the control portion 350 determines that the output of the fluid sensor 352 corresponds to the data freshly received in respect of fuel type stored by the RFID tag 360, the control portion 350 permits the valve device 320 to open, even though the data in respect of the tank to which the apparatus 300 is connected has changed, indicating that the apparatus 300 has been moved to a different tank. If the control portion 350 determines that the output of the fluid sensor 352 does not correspond to the data in respect of fuel type stored by the tag 360, the control portion 350 does not permit the valve device 320 to open and the apparatus 300 provides an audible and visual alert to a user, the visual alert being provided via LCD display 356. The control portion 350 also stores in memory a record of the fact that a mismatch was detected. Thus, in some embodiments, if the apparatus 300 determines that the apparatus has been moved by detecting that the data read from the tag has changed, it accepts the change in data and electronically latches to the new tag. In some embodiments it will then permit the valve device 320 if correspondence is found between the fuel identified by the fluid inspection sensor 352 and the new permitted fuel information received from the new tag 360.

An operator may override the control portion 350 and force the control portion 350 to cause the valve device 320 to open by means of a portable radio frequency (RF) remote control device 363 similar to that described above in respect of the embodiment of FIG. 2. In some embodiments, in response to an override signal, the control portion 350 opens the control valve 320 for a predetermined time period such as 1 min, 2 min or other suitable time period, for example a time period sufficient to permit draining of fuel in the hose 7 connected to the apparatus 300. The device 363 communicates with the control portion 350 via a radio communications module (similar to the module 157B described in respect of FIG. 5). In some embodiments the device 363 communicates with the control portion 350 via the reader module 357A. In the present embodiment the control portion 350 stores in a memory thereof, for later retrieval, information indicative of the fact that a manual override took place. The control portion 350 may also store information indicative for the period of time for which the manual override took place, i.e. the period of time for which the valve device 320 was open.

In some embodiments, in addition to or instead of an RFID tag 360 attached to the tank inlet 330IN, magnetic identifier elements may be co-located with the fluid storage tank inlet 330IN to which the apparatus is coupled. The magnetic identifier elements may encode information in respect of the type of fluid permitted to be stored in the tank 330 to which the apparatus 300 is connected and may be read by a magnetic detector comprised by the apparatus 300. The magnetic identifier elements may encode information by virtue of their polar orientation with respect to one another and/or a reference orientation. In some alternative embodiments a panel bearing a bar code may be provided at the inlet 300IN arranged to be read by a barcode reader forming part of the apparatus 300.

In some embodiments, the apparatus 300 may receive or be pre-programmed with information indicative of the identity of a fluid storage tank 330 into which fluid of a given type is to be dispensed. The control portion 350 may be configured to determine the type of fuel permitted to be delivered to the storage tank 330 to which the apparatus 300 is connected, based on information received from the reader module 357A in respect of the identity of the tank 330 to which the apparatus is connected rather than information in respect of permitted fuel.

In some embodiments, the apparatus 300 is arranged such that the reader module 357A repeatedly reads the RFID tag 360 associated with the tank inlet 330IN to which the apparatus 300 is connected and provides the information to the control portion 350, which stores the information in memory. As in the case of other embodiments described herein, the data is stored together with the current date and time, or information indicative thereof. The control portion 350 monitors the information received from the reader module 357A and once liquid is detected in the apparatus 300 by means of the liquid presence sensor 358, the control portion 350 determines the liquid type by means of fluid inspection sensor 352 and compares the liquid type with the most recently received permitted fluid information from the reader module 357A. If the liquid type determined by the fluid inspection sensor 352 corresponds to the most recently received permitted fluid information from the reader module 357A, the control portion 350 causes the valve device 320 to open, and liquid to be supplied to the fuel tank inlet 330IN.

It is to be understood that the feature that the apparatus 300 re-checks the type of liquid corresponding to the information stored by the RFID tag 360 has the advantage that the problem of misfuel events can be further reduced. This is because if an operator connects the apparatus 300 to a first fluid tank inlet 330IN, causing the control portion 350 to read the associated RFID tag 360 and store it in memory, and subsequently disconnects the apparatus and connects it to a second fluid tank inlet 330IN with an associated RFID tag 360 corresponding to a different fluid type, the system will read the RFID tag 360 corresponding to the second fluid tank and compare the fluid type associated with that RFID tag 360 with the output of the fluid sensor 252 before permitting the valve 320 to open.

It is to be understood that, following switching on of the apparatus 300, once the control portion 350 has started receiving tag information from the reader module 357A, the control portion 350 may store freshly received tag information and overwrite the tag information most recently stored since the apparatus 300 was switched on until liquid has been detected in the apparatus 300 by the liquid presence sensor 358 and its identity determined by the fluid inspection sensor 352. The apparatus 300 may retain the most recently received tag information when the identity of the liquid has been determined by the fluid inspection sensor 352, and store, with that information, information indicative of the identity of the liquid determined by the fluid inspection sensor 352.

In some embodiments, the control portion 350 may continue to receive information indicative of tag identity from the reader module 357A for a predetermined period such as 30 s, 60 s or any other period, following opening of the valve device 320. Thus, the control portion 350 continues to electronically latch the apparatus to the tag 360 of the inlet 330IN following opening of the valve device 320.

In some embodiments the control portion 350 may continue receiving tag identity information throughout the period for which the control valve 320 is open, maintaining the electronic latching throughout this period. In the event that a change in the information occurs whilst the valve 320 is open the control portion 350 may be configured to close the valve 320 and log in memory thereof the fact that a change occurred.

It is to be understood that, one the liquid presence sensor 358 determines that liquid is no longer present in the conduit 310, the apparatus 300 may determine that the delivery is complete. It is to be understood that an output of the fluid inspection sensor 352 may in addition provide an indication that the fluid in contact with the sensor 352 no longer corresponds to the permitted fluid information.

Once the control portion 350 determines, by reference to the liquid presence sensor 358 (or fluid inspection sensor 152 in the absence of a liquid presence sensor 358) that the liquid is no longer present in the conduit 310, the control portion 350 closes the valve 320 and switches itself off. In some embodiments, the control portion 350 may close the valve 320 a predetermined time period after the liquid presence sensor 358 and/or the fluid inspection sensor 352 detect that liquid is no longer present, to allow an operator time to drain any fluid trapped in the delivery hose 7 between the tanker 5 and the apparatus 300. Alternatively, the apparatus 300 may require the operator to override the control portion 350, forcing it to open the valve device 320, by actuation of the portable RF remote control device 363. In some embodiments, if the predetermined time period for which the apparatus 300 retains the control valve 320 in the open condition following completion of a delivery is insufficient to allow draining of liquid in the hose 7, the operator may nevertheless override the control portion 300 by means of RF remote control device 363.

It is to be understood that, in some embodiments not employing a liquid presence sensor, the control portion 150 may confirm that an output of the fluid inspection sensor 152 corresponds to air when the apparatus 100 is first switched on. The control portion 150 may then monitor the output of the fluid inspection sensor 152 and when the output changes from air, determine whether the output corresponds to permitted fluid information.

In such embodiments, the presence of water vapour or dirt such as sludge on the exposure surface 152PS of the sensor 152 either when the apparatus 100 is first switched on, or prior to liquid fuel filling the conduit 110 of the apparatus 100, may result in the control portion 150 determining that a misfuel event has occurred because the output of the fluid inspection sensor 152 may not correspond to air or a permitted fuel. Accordingly, it is to be understood that an advantage of the use of a liquid presence sensor or detector 358 is that the control portion 350 may confirm that liquid is present in the conduit 310 before checking whether fluid in contact with the exposure surface 152PS of the fluid inspection sensor 352 is permitted liquid, reducing the risk that the apparatus 300 falsely determines that a misfuel event is occurring during liquid fuel filling operations.

Some embodiments of the invention may be understood by reference to the following numbered clauses:

1. A portable fuel filling apparatus, optionally fuel filling elbow apparatus, comprising:
   - a fluid inlet for coupling to a fluid source, a fluid outlet for coupling to a fluid storage tank inlet and a conduit disposed therebetween;
   - fluid inspection means for inspecting a fluid within the conduit, the inspection means being configured to provide an output indicative of a type of fluid in the conduit;
   - valve means operable selectively to prevent or allow flow of fluid through the conduit from the fluid inlet to the fluid outlet;
   - input means for receiving permitted fluid information being information indicative of a type of fluid that is to be permitted to flow through the conduit; and
   - control means configured automatically to cause the valve means to prevent or allow flow of fluid through the conduit in dependence on the output of the fluid inspection means and the permitted fluid information received by the input means, the input means comprising a radio receiver.

2. Apparatus as described in clause 1 wherein the input means comprises a radio frequency identification (RFID) tag reader, the tag reader comprising the radio receiver.

3. Apparatus as described in clause 2 wherein the input means is configured to receive the fluid information and in addition information indicative of the identity of a storage tank to which the apparatus is coupled, the apparatus being configured to store the information indicative of tank identity and the permitted fluid information for that tank.

4. Apparatus as described in any preceding clause wherein the control means is further configured to communicate with a fluid level monitoring system and receive fill level information indicative of a level of fluid in a fluid storage tank.

5. Apparatus as described in clause 4 as dependent on clause 3 wherein the control means is configured to communicate with the fluid level monitoring system and receive fill level information indicative of the level of fluid in the fluid storage tank to which the apparatus is connected based on the information indicative of the identity of the storage tank to which the apparatus is coupled.

6. Apparatus according to clause 4 or clause 5 wherein the control means is configured to automatically cause the valve means to prevent flow of fluid through the conduit if the fill level information indicates the fill level is at least at a predetermined shut-off level.

7. Apparatus according to any one of clauses 4 to 6 wherein the control means is configured automatically to provide an alert to an operator if the fill level information indicates the fill level is at least at a predetermined alert level.

8. Apparatus according to clause 7 as dependent on clause 6 wherein the predetermined alert level is less than the predetermined shut-off level.

9. Apparatus according to any one of clauses 4 to 8 wherein the apparatus is configured to communicate with the fluid level monitoring system by means of a wireless link.

10. Apparatus according to any preceding clause comprising an electrical generator configured to generate electrical power to charge a charge storage device in response to flow of fluid through the apparatus.

11. Apparatus according to clause 10 wherein the electrical generator comprises a turbine element arranged to be exposed to flow of fluid through the apparatus in use.

12. Apparatus according to any preceding clause wherein the valve means comprises an electrically actuated valve.

13. A method of preventing misfuelling by means of portable fuel filling elbow apparatus, the method comprising:
   - coupling a fluid outlet of a portable fuel filling elbow apparatus to a fluid storage tank inlet;
   - coupling a fluid inlet of the elbow apparatus to a fluid source;
   - causing fluid from the fluid source to enter a conduit of the apparatus;
   - inspecting the fluid in the conduit by means of inspection means comprised by the apparatus, the inspection means providing an output to a control means comprised by the apparatus indicative of a type of fluid in the conduit;

receiving by means of a radio receiver of an input means comprised by the apparatus permitted fluid information being information indicative of a type of fluid that is to be permitted to flow through the conduit; and automatically causing, by means of the control means, the valve means to prevent or allow flow of fluid through the conduit in dependence on the output of the fluid inspection means and the permitted fluid information received by the input means.

Further embodiments of the present invention may be understood by reference to the following separately numbered clauses and statements:

1. A fuel filling apparatus comprising:

a fluid inlet for coupling to a fluid source, a fluid outlet for coupling to a fluid storage tank inlet and a conduit disposed therebetween;

fluid inspection means for inspecting a fluid within the conduit, the inspection means being configured to provide an output indicative of a type of fluid in the conduit;

valve means operable selectively to prevent or allow flow of fluid through the conduit from the fluid inlet to the fluid outlet;

input means for receiving permitted fluid information associated with the fluid storage tank inlet to which the apparatus is coupled, being information indicative of a type of fluid that is to be permitted to flow through the conduit to the fluid storage tank inlet; and control means configured automatically to cause the valve means to prevent or allow flow of fluid through the conduit in dependence on the output of the fluid inspection means and the permitted fluid information received by the input means.

2. Apparatus according to clause 1 comprising liquid presence determining means for determining whether liquid is present in the conduit of the apparatus.

It is to be understood that the liquid presence determining means may comprise a separate liquid presence sensor. Alternatively, the fluid inspection means may be configured to determine whether liquid is present in the conduit, providing the liquid presence determining means.

3. Apparatus according to clause 2 wherein the apparatus is configured to receive fresh permitted fluid information via the input means once it is has been determined that liquid is present in the conduit by means of the liquid presence determining means.

4. Apparatus according to any one of clauses 1 to 3 wherein the apparatus is configured to receive fresh permitted fluid information via the input means once it is has been determined that fluid in the conduit corresponds to the permitted fluid information previously received, the control means being configured automatically to cause the valve means to prevent or allow flow of fluid through the conduit in dependence on the output of the fluid inspection means and the freshly received permitted fluid information received by the input means.

Thus, in the event that the fresh permitted fluid information corresponds to the output of the fluid inspection means, the control means causes the valve means to allow fluid flow therethrough.

Some embodiments of the present invention have the advantage that an accidental or intentional misfuelling event due to movement of the apparatus from the inlet of a first fluid storage tank to that of a second may be prevented. This is because, before causing the valve means to allow fluid flow therethrough, the apparatus receives fresh permitted fluid information and ensures that the output of the fluid inspection means matches the fresh permitted fluid information associated with the inlet of the fluid storage tank to which the apparatus is coupled. Thus, if after being coupled to a first fluid storage tank inlet the apparatus is subsequently moved to the inlet of a second fluid storage tank, the apparatus confirms that the output of the fluid inspection means matches the permitted fluid information associated with the second fluid storage tank before allowing the valve means to permit fluid flow therethrough, preventing a misfuel event in the event of a mismatch between fluid in the conduit of the apparatus and the permitted fluid information.

In some embodiments the apparatus is configured to receive, in advance of use, information indicative of the identity of one or more tanks or inlets and the type(s) of fluid that is(are) permitted to be dispensed into each of the one or more tanks or inlets. The apparatus may be configured to receive information indicative of the identity of a tank or inlet to which the apparatus is connected and determine, from information stored by the apparatus, the identity of the fuel that it is permitted to deliver. In some embodiments the apparatus may be configured to access a remote data storage device such as a server, and obtain information in respect of the liquid that it is permitted to deliver to that inlet or tank.

It is to be understood that, in some embodiments, the apparatus is configured repeatedly to receive permitted fluid information repeatedly when switched on. In some embodiments, the apparatus is configured repeatedly to receive permitted fluid information repeatedly for a predetermined time period following powering up of the apparatus. In some embodiments, the apparatus is configured repeatedly to receive permitted fluid information when switched on until the control means determines that the valve means may be opened.

The apparatus may be configured such that, when initially connected to a fluid tank inlet, or initially switched on, the apparatus receives permitted fluid information via the input means. The apparatus may provide an output corresponding to the permitted fluid information, for example by means of a visual output such as by illuminating a lamp corresponding to the permitted fluid or via a display such as a digital display, optionally a liquid crystal display (LCD) panel. This feature has the advantage that an operator can confirm that the fluid the apparatus is expecting corresponds to the fluid the operator intends to deliver. The apparatus may then be configured to receive fresh permitted fluid information via the input means once it is has been determined that fluid in the conduit corresponds to the permitted fluid information initially received, the control means being configured automatically to cause the valve means to prevent or allow flow of fluid through the conduit in dependence on the output of the fluid inspection means and the freshly received permitted fluid information received by the input means.

In some embodiments the apparatus may continue to monitor the permitted fluid information via the input means whilst the valve means is permitting fluid flow therethrough, the apparatus being configured to cause the valve means to prevent fluid flow therethrough in the event that the input means indicates that the permitted fluid information has changed.

The apparatus may comprise an electrical generator configured to generate electrical power to charge a charge storage device, the charge storage device being arranged to provide a supply of electrical power for the apparatus. The electrical generator may generate charge in response to flow of fluid through the apparatus during a fuel filling operation in which fluid flows from the fluid source to the fluid storage tank via the conduit. The electrical generator may be provided in the form of an electric machine such as a dynamo or other generator, configured to generate electrical power in response to turning of a turbine or impeller driven by flow of fluid through the apparatus.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. Apparatus for preventing an undesirable fluid from flowing into a fuel receiving inlet of a fuel storage tank, comprising:

a fluid inlet for receiving fluid from a fluid source, a fluid outlet and a conduit disposed therebetween;

a sensor within the conduit configured to provide an output indicative of a type of fluid in the conduit;

a valve selectively operable to prevent or allow flow of fluid through the conduit from the fluid inlet to the fluid outlet;

a controller configured to automatically cause the valve to prevent or allow flow of fluid through the conduit in dependence on the output of the sensor and permitted fluid information, the permitted fluid information being information indicative of a type of fluid that is to be permitted to flow through the conduit; and an electrical generator configured to generate electrical power to charge a charge storage device in response to flow of fluid through the apparatus during an operation in which fluid flows from the fluid inlet to the fluid outlet via the conduit, the charge storage device being arranged to provide a supply of electrical power to the valve and controller of the apparatus, wherein the apparatus is portable, and wherein the apparatus comprises a connector that is adjacent the fluid outlet and that is configured to detachably couple to an inlet of the fuel storage tank.

2. The apparatus of claim 1, wherein the electrical generator comprises a turbine element arranged to be driven by a flow of fluid through the apparatus, in use, thereby to cause the electrical generator to generate electrical power.

3. The apparatus of claim 1, wherein the connector is an above-ground connector, and wherein the valve resides above the connector.

4. The apparatus of claim 2, wherein a diameter of the turbine element is substantially equal to a diameter of the conduit.

5. The apparatus of claim 2, wherein the turbine element is provided substantially within the conduit.

6. The apparatus of claim 2, wherein substantially all fluid flowing through the conduit impinges on the turbine element thereby to promote rotation of the turbine element.

7. The apparatus of claim 2, wherein at least a portion of the conduit that is substantially immediately downstream of the turbine element, with respect to a direction of flow of fluid through the apparatus from the fluid inlet to the fluid outlet, is of substantially the same diameter as the turbine element or of a smaller diameter than the turbine element.

8. The apparatus of claim 1, further comprising an input for receiving the permitted fluid information.

9. The apparatus of claim 8 wherein the input comprises a radio receiver.

10. The apparatus of claim 8, wherein the input comprises a radio frequency identification (RFID) reader.

11. The apparatus of claim 8, wherein the input is configured to receive the fluid information and additional information indicative of an identity of the fuel storage tank to which the apparatus is coupled, the apparatus being configured to store the information indicative of tank identity and the permitted fluid information for that fuel storage tank.

12. The apparatus of claim 1, wherein the controller is further configured to communicate with a fluid level monitoring system and receive fill level information indicative of a level of fluid in the fuel storage tank, and wherein the controller is configured to power down when the connector is disconnected from the inlet of the fuel storage tank and is further configured to power up when the connector is connected to the inlet of the fuel storage tank.

13. The apparatus of claim 12, wherein the controller is configured to automatically cause the valve to prevent flow of fluid through the conduit if the fill level information indicates the fill level is at least at a predetermined shut-off level.

14. The apparatus of claim 12, wherein the controller is configured automatically to provide an alert to an operator if the fill level information indicates the fill level is at least at a predetermined alert level.

15. The apparatus of claim 12, wherein the apparatus is configured to wirelessly communicate with the fluid level monitoring system.

16. The apparatus of claim 1, wherein the connector comprises a clamp connected to a handle, wherein the handle is movable between locked and unlocked positions to move the clamp between respective tightened and release configurations, and wherein when in the tightened configuration, the clamp applies a clamp force to connect to the fluid receiving inlet of the fuel storage tank.

17. The apparatus of claim 16, wherein the apparatus comprises a switch communicatively coupled to the controller and the handle, wherein, when the handle is initially moved to the locked position to place the clamp in the tightened position, the switch sends a signal to the controller to initiate a power on state from a power off state corresponding to when the handle is in the unlocked position.

18. A method of preventing an undesirable fluid from flowing into a fuel receiving inlet of a fuel storage tank comprising:

providing a portable mis-fueling apparatus having a fluid inlet and a fluid outlet spaced apart along a conduit;

coupling the fluid inlet of the apparatus to a fluid source;

coupling the fluid outlet to the fuel receiving inlet of the fuel storage tank;

causing fluid from the fluid source to enter the conduit of the apparatus via the fluid inlet of the apparatus;

inspecting the fluid in the conduit using a sensor, the sensor providing an output indicative of a type of fluid in the conduit to a controller;

automatically directing a valve of the apparatus to prevent or allow flow of fluid through the conduit to the fluid outlet of the apparatus in dependence on the output of the sensor and permitted fluid information indicative of a type of fluid that is to be permitted to flow through the conduit to the fluid outlet;

generating electrical power to charge a charge storage device coupled to or onboard the apparatus in response to flow of fluid through the apparatus from the fluid source to the fuel receiving inlet of the fuel storage tank via the conduit; and providing a supply of electrical power for the apparatus from the charge storage device to power the controller and the valve.

19. A method according to claim 18, wherein the generating electrical power is carried out using a turbine element that is driven by the flow of fluid through the apparatus, wherein the method further comprises:

detecting when the apparatus is initially connected to the fuel receiving inlet and powering the controller in response to the detected initial connection; and detecting when the apparatus is disconnected from the fuel receiving inlet and powering down the controller in response to the detected disconnection.

20. A method according to claim 18, further comprising, prior to the automatically directing, receiving the permitted fluid information using an input of the apparatus.

21. A method according to claim 20, wherein the input comprises a radio receiver.

22. A method according to claim 18, wherein the apparatus is serially, releasably coupleable to different fuel storage tanks and different fluid sources.

* * * * *